US010564566B2

(12) United States Patent
Koga et al.

(10) Patent No.: US 10,564,566 B2
(45) Date of Patent: Feb. 18, 2020

(54) DEVELOPING DEVICE WITH A REGULATION BLADE MOUNTED SEAL MEMBER

(71) Applicant: CANON KABUSHIKI KAISHA, Tokyo (JP)

(72) Inventors: Shunichi Koga, Abiko (JP); Teruaki Tsurusaki, Moriya (JP); Tomohiro Shiomi, Abiko (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/202,261

(22) Filed: Nov. 28, 2018

(65) Prior Publication Data

US 2019/0171130 A1 Jun. 6, 2019

(30) Foreign Application Priority Data

Dec. 5, 2017 (JP) ..... 2017-233793

(51) Int. Cl.
*G03G 15/08* (2006.01)

(52) U.S. Cl.
CPC ..... *G03G 15/0812* (2013.01); *G03G 15/0881* (2013.01)

(58) Field of Classification Search
CPC ..... G03G 15/0812; G03G 15/0881; G03G 15/0898
See application file for complete search history.

(56) References Cited

U.S. PATENT DOCUMENTS 9,239,539 B2 1/2016 Yasumoto et al.
9,348,255 B2 5/2016 Kanai et al.
2009/0136257 A1* 5/2009 Hattori ..... G03G 21/206 399/111
2013/0034368 A1* 2/2013 Hattori ..... G03G 15/0881 399/106
2014/0169827 A1* 6/2014 Hattori ..... G03G 15/0882 399/106

FOREIGN PATENT DOCUMENTS

JP 2015-034929 A 2/2015
JP 2015-057624 A 3/2015
JP 2015-069190 A 4/2015
JP 2015-090398 A 5/2015

OTHER PUBLICATIONS

Tomohiro Shiomi et al., U.S. Appl. No. 16/113,371, filed Aug. 27, 2018.
Shunichi Koga et al., U.S. Appl. No. 16/183,973, filed Nov. 8, 2018.

* cited by examiner

*Primary Examiner* — Sophia S Chen
(74) *Attorney, Agent, or Firm* — Venable LLP

(57) ABSTRACT

In a state that a developing device is placed in a position for developing an electrostatic latent image formed on an image bearing member when the regulation blade has a mount portion for mounting a seal member, the regulation blade is fixed to a mount portion of the development frame for mounting the regulation blade, and a seal member is fixed to a mount portion of the regulation blade for mounting the seal member, the seal member is arranged to make contact with the image bearing member vertically under a position where the developer bearing member is closest to the image bearing member to seal at least a part of a space formed between the developing device and the image bearing member.

16 Claims, 16 Drawing Sheets

DEVELOPING DEVICE WITH A REGULATION BLADE MOUNTED SEAL MEMBER

BACKGROUND OF THE INVENTION

Field of the Invention

The present invention relates to a developing device having a resin-based developer regulation member.

Description of the Related Art

A developing device has a development frame, a rotatable developer bearing member configured to bear a developer including a toner and a carrier to develop an electrostatic latent image formed on an image bearing member, and a developer regulation member configured to regulate the amount of the developer borne on the developer bearing member. The developer regulation member is arranged to face the developer bearing member by interposing a predetermined gap (hereinafter, referred to as a SB gap) with the developer bearing member in parallel with a rotational axis of the developer bearing member. The SB gap is a shortest distance between the developer bearing member and the developer regulation member. The amount of the developer conveyed to a developing region of the image bearing member facing the developer bearing member is adjusted by adjusting a size of the SB gap.

The developer conveyed to the developing region is grown on the developing region to form a magnetic brush. In addition, the toner of the developer supplied from the magnetic brush in the developing region is supplied to the electrostatic latent image, so that the electrostatic latent image is developed as a toner image. Meanwhile, a part of the toner of the developer supplied from the magnetic brush is not attached to the electrostatic latent image in the developing region and may be scattered from the developing region in some cases. For this reason, in particular, in a space downward in a gravity direction from the developing region, the amount of the toner floating due to a self weight of the toner scattered from the developing region easily increases relatively.

The developing device described in Japanese Patent Laid-Open No. 2015-69190 has a developer regulation member made of metal, a seal member (hereinafter, referred to as a seal member) that abuts on the image bearing member to capture the toner scattered downward in the gravity direction from the developing region, and a seal support member for supporting the seal member.

A seal mount portion (hereinafter, referred to as a seal mount portion) for mounting the seal member to the developing device so as to make the seal member abut on the image bearing member is desirably provided in the vicinity of the image bearing member downward in the gravity direction from the developing region from the viewpoint of mountability of the seal member to the developing device.

Meanwhile, in the developing device configured such that the developer regulation member is disposed vertically downward from a position where the developer bearing member is closest to the image bearing member, the developer regulation member is provided downward from the developing region in the gravity direction and in the vicinity of the image bearing member. For this reason, in the developing device having such a configuration, a distance between a position of the developer regulation member and a position of the seal mount portion tends to be close.

In Japanese Patent Laid-Open No. 2015-69190, in order to mount the seal member to the developer regulation member made of metal, the seal support member for supporting the seal member is interposed between the seal member and the developer regulation member made of metal. For this reason, in the configuration of Japanese Patent Laid-Open No. 2015-69190, it is necessary to provide the seal support member separately from the seal member and the developer regulation member made of metal, so that the number of components increases.

In recent years, a developing device having a resin-based developer regulation member molded from resin and a resin-based development frame molded from resin is known (see Japanese Patent Laid-Open No. 2015-34929).

In general, resin has a high degree of freedom in molding relative to metal. In this regard, in order to reduce the number of components, it is conceived that the seal mount portion is molded integrally with the development frame made of resin. However, in a case where the seal mount portion is molded integrally with the resin-based development frame, mountability of the developer regulation member to the development frame may be degraded if the developer regulation member collides with the seal mount portion during mounting of the developer regulation member to the development frame. This is particularly serious when a distance between the mount position of the developer regulation member and the mount position of the seal mount portion is close in the developing device configured such that the developer regulation member is disposed vertically downward from a position where the developer bearing member is closest to the image bearing member. In this regard, in the developing device having such a configuration, it is conceived that the seal mount portion is molded integrally with the resin-based developer regulation member in order to reduce the number of components and prevent degradation of mountability of the developer regulation member to the development frame.

SUMMARY OF THE INVENTION

It is desirable to suppress the toner from being scattered to the outside of the developing device from a space between the developing device and the image bearing member without harming mountability of the resin-based regulation blade to the resin-based development frame provided separately from the resin-based regulation blade.

In order to solve the above issue, according to an aspect of the invention, there is provided a developing device that includes a developer bearing member rotatably provided to bear a developer including a toner and a carrier for developing an electrostatic latent image formed on a rotatable image bearing member, a regulation blade made of resin and arranged to face the developer bearing member vertically under a position where the developer bearing member is closest to the image bearing member without making contact with the developer bearing member for regulating the amount of the developer borne on the developer bearing member in a state that the developing device is placed in a position for developing an electrostatic latent image formed on the image bearing member, a development frame made of resin and configured separately from the regulation blade to accommodate the developer, the development frame having a mount portion for mounting the regulation blade, and a seal member. The regulation blade has a mount portion for mounting the seal member, and in a state that the developing device is placed in the position for developing the electrostatic latent image formed in the image bearing member when the regulation blade is fixed to the mount portion of the development frame for mounting the regulation blade, and the seal member is fixed to the mount portion of the regulation blade for mounting the seal member, the seal member is arranged to make contact with the image bearing member vertically under the position where the developer bearing member is closest to the image bearing member to seal at least a part of a space formed between the developing device and the image bearing member.

According to another aspect of the invention, there is provided a developing device that includes a developer bearing member rotatably provided to bear a developer including a toner and a carrier for developing an electrostatic latent image formed on a rotatable image bearing member, a regulation blade made of resin and arranged to face the developer bearing member vertically under a position where the developer bearing member is closest to the image bearing member without making contact with the developer bearing member for regulating the amount of the developer borne on the developer bearing member in a state that the developing device is placed in a position for developing an electrostatic latent image formed on the image bearing member, a development frame made of resin and configured separately from the regulation blade to accommodate the developer, the development frame having a mount portion for mounting the regulation blade, and a seal member. The regulation blade has a mount portion for mounting the seal member, and in a state that the developing device is placed in the position for developing an electrostatic latent image formed on the image bearing member when the regulation blade is fixed to the mount portion of the development frame for mounting the regulation blade, and the seal member is fixed to the mount portion of the regulation blade for mounting the seal member, the seal member is arranged to make contact with the developer bearing member in a downstream side of the rotational direction from a position where the developer bearing member is closest to the regulation blade and in an upstream side of the rotational direction from the position where the developer bearing member is closest to the image bearing member in a rotational direction of the developer bearing member to seal at least a part of a space formed between the developing device and the image bearing member.

According to still another aspect of the invention, there is provided a developing device that includes a developer bearing member rotatably provided to bear a developer including a toner and a carrier for developing an electrostatic latent image formed on a rotatable image bearing member, a regulation blade made of resin and arranged to face the developer bearing member vertically under a position where the developer bearing member is closest to the image bearing member without making contact with the developer bearing member for regulating the amount of the developer borne on the developer bearing member in a state that the developing device is placed in a position for developing an electrostatic latent image formed on the image bearing member, a development frame made of resin and configured separately from the regulation blade to accommodate the developer, the development frame having a mount portion for mounting the regulation blade, and a seal member. The regulation blade has a mount portion for mounting the seal member, and in a state that the developing device is placed in the position for developing an electrostatic latent image formed on the image bearing member when the regulation blade is fixed to the mount portion of the development frame for mounting the regulation blade, and the seal member is fixed to the mount portion of the regulation blade for mounting the seal member, the seal member is arranged to face the developer bearing member without making contact with the developer bearing member in a downstream side of the rotational direction from a position where the developer bearing member is closest to the regulation blade and in an upstream side of the rotational direction from the position where the developer bearing member is closest to the image bearing member in a rotational direction of the developer bearing member to seal at least a part of a space formed between the developing device and the image bearing member.

Further features of the present invention will become apparent from the following description of exemplary embodiments with reference to the attached drawings.

DESCRIPTION OF THE EMBODIMENTS

Embodiments of the invention will now be described with reference to the accompanying drawings. Note that the following embodiments are not intended to limit the invention relating to the claims, and all combinations of characteristics described in the first embodiment are not necessarily indispensable for the solving means of the invention. The invention may be employed in various fields such as a printer, various print machines, a copying machine, a facsimile, and a multi-function peripheral.

First Embodiment (Configuration of Image Forming Apparatus)

Figure 1:
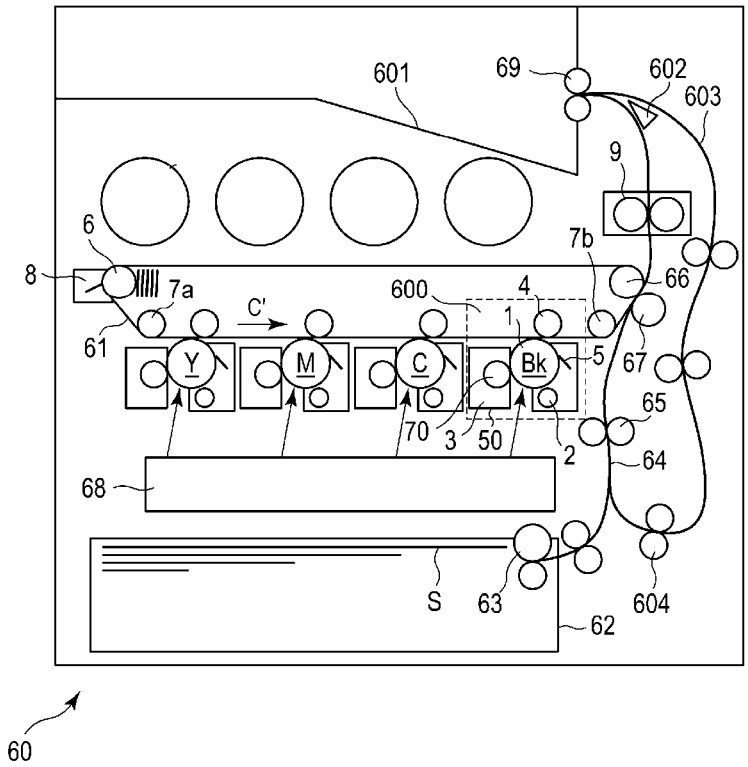
FIG. 1 is a cross-sectional view illustrating a configuration of an image forming apparatus.

First, a configuration of the image forming apparatus according to the first embodiment of the invention will be described with reference to a cross-sectional view of FIG. 1. As illustrated in FIG. 1, the image forming apparatus 60 includes an endless intermediate transfer belt (ITB) 61 as an intermediate transfer member, and four image forming portions 600 from an upstream side to a downstream side along a rotational direction of the intermediate transfer belt 61 (in the arrow direction C of FIG. 1). The respective image forming portion 600 forms a toner image of a respective color including yellow (Y), magenta (M), cyan (C), and black (Bk).

The image forming portion 600 has a rotatable photosensitive drum 1 as an image bearing member. In addition, the image forming portion 600 has a charging roller 2 arranged along a rotational direction of the photosensitive drum 1 to function as a charging unit, a developing device 3 as a developing unit, a primary transfer roller 4 as a primary transfer unit, and a photoreceptor cleaner 5 as a photoreceptor cleaning unit.

Each developing device 3 is detachably attachable to the image forming apparatus 60. Each developing device 3 has a developing container 50 that houses a non-magnetic toner (hereinafter, simply referred to as a toner) and a two-component developer (hereinafter, simply referred to as a developer) having a magnetic carrier. In addition, each toner cartridge that houses toners of respective colors Y, M, C, and Bk is detachably attachable to the image forming apparatus 60. The toners of respective colors Y, M, C, and Bk are supplied to the developing container 50 along a toner conveyance path. Note that details of the developing device 3 will be described below with reference to FIGS. 2 to 4, and details of the developing container 50 will be described below with reference to FIG. 5.

The intermediate transfer belt 61 is looped around a tension roller 6, a follower roller 7*a*, a primary transfer roller 4, a follower roller 7*b*, and a secondary transfer inner roller 66 and is conveyed and driven in the arrow direction C' of FIG. 1. The secondary transfer inner roller 66 also functions as a driving roller for driving the intermediate transfer belt 61. The intermediate transfer belt 61 is rotated in the arrow direction C' of FIG. 1 as the secondary transfer inner roller 66 rotates.

The intermediate transfer belt 61 is pressed by the primary transfer roller 4 from the back side of the intermediate transfer belt 61. In addition, as the intermediate transfer belt 61 abuts on the photosensitive drum 1, a primary transfer nip portion as a primary transfer unit is formed between the photosensitive drum 1 and the intermediate transfer belt 61.

An intermediate transfer member cleaner 8 as a belt cleaning unit abuts on a position facing the tension roller 6 by interposing the intermediate transfer belt 61. In addition, a secondary transfer outer roller 67 as a secondary transfer unit is arranged in a position facing the secondary transfer inner roller 66 by interposing the intermediate transfer belt 61. The intermediate transfer belt 61 is nipped between the secondary transfer inner roller 66 and the secondary transfer outer roller 67. As a result, a secondary transfer nip portion as a secondary transfer unit is formed between the secondary transfer outer roller 67 and the intermediate transfer belt 61. In the secondary transfer nip portion, the toner image is absorbed to a surface of a sheet S (such as paper or film) by applying a predetermined pressing force and a transfer bias (electrostatic load bias).

The sheet S is housed in a sheet storage 62 (such as a sheet cassette or a sheet deck) in a loaded state. A feeding unit 63 feeds the sheet S at the image forming timing using a frictional separation system, for example, including a feeding roller. The sheet S fed by the feeding unit 63 is conveyed to the registration roller 65 disposed in the middle of the conveyance path 64. After the registration roller 65 performs skew feeding correction or timing correction, the sheet S is conveyed to the secondary transfer nip portion. In the secondary transfer nip portion, the secondary transfer operation is performed by matching the timings between the sheet S and the toner image.

A fixing device 9 is arranged in a downstream side from the secondary transfer nip portion in a conveyance direction of the sheet S. As a predetermined pressure and a heat amount are applied from the fixing device 9 to the sheet S conveyed to the fixing device 9, a toner image is held and fixed on a surface of the sheet S. In this manner, the sheet S having a fixed image is directly discharged to the discharge tray 601 by virtue of forward rotation of the discharge roller 69.

When images are formed on both sides, the sheet S is conveyed until a trailing end of the sheet S passes through a switching flapper 602 by virtue of forward rotation of the discharge roller 69. Then, the discharge roller 69 is rotated reversely. As a result, leading and trailing ends of the sheet S are exchanged, and the sheet S is conveyed to a duplex conveying path 603. Then, the sheet S is conveyed to the conveyance path 64 again by a re-feeding roller 604 in synchronization with the next image forming timing.

(Image Forming Process)

At the time of image formation, the photosensitive drum 1 is rotatably driven by a motor. The charging roller 2 uniformly electrically charges a surface of the rotatably driven photosensitive drum 1 in advance. An exposure device 68 forms an electrostatic latent image on a surface of the photosensitive drum 1 electrically charged by the charging roller 2 on the basis of an image information signal input to the image forming apparatus 60. The photosensitive drum 1 can form a plurality of sizes of electrostatic latent images.

The developing device 3 has a rotatable developing sleeve 70 as a developer bearing member for bearing the developer. The developing device 3 develops the electrostatic latent image formed on a surface of the photosensitive drum 1 using a developer borne on a surface of the developing sleeve 70. As a result, a toner is attached to an exposure portion on a surface of the photosensitive drum 1 to form a visible image. A transfer bias (electrostatic load bias) is applied to the primary transfer roller 4 to transfer the toner image formed on the surface of the photosensitive drum 1 to the intermediate transfer belt 61. A small amount of the toner remaining on the surface of the photosensitive drum 1 after the primary transfer (transfer residual toner) is recovered by the photoreceptor cleaner 5, and the next image forming process is prepared again.

The image forming processes for respective colors processed by the image forming portions 600 of respective colors Y, M, C, and Bk in parallel are performed at the timing that the images are sequentially superimposed on the toner image having an upstream color primarily transferred onto the intermediate transfer belt 61. As a result, a full-color toner image is formed on the intermediate transfer belt 61, and the toner image is conveyed to the secondary transfer nip portion. A transfer bias is applied to the secondary transfer outer roller 67, so that the toner image formed on the intermediate transfer belt 61 is transferred onto the sheet S conveyed to the secondary transfer nip portion. A small amount of the toner remaining on the intermediate transfer belt 61 after the sheet S passes through the secondary transfer nip portion (transfer residual toner) is recovered by the intermediate transfer member cleaner 8. The fixing device 9 fixes the toner image transferred onto the sheet S. A recording material subjected to a fixing process using the fixing device 9 is discharged to the discharge tray 601.

As a series of the image forming processes described above are completed, the next image forming operation is prepared.

(Configuration of Developing Device)

A typical configuration of the developing device will be described with reference to a perspective view of FIG. 2, a perspective view of FIG. 3, and a cross-sectional view of FIG. 4. FIG. 4 is a cross-sectional view illustrating a cross section H of the developing device 3 of FIG. 2.

The developing device 3 has a resin-based development frame molded from resin (hereinafter, simply referred to as a development frame 30) and a resin-based developing container 50 molded from resin and provided separately from the development frame 30 (hereinafter, simply referred to as a cover frame 40). FIGS. 2 and 4 illustrate a state in which the cover frame 40 is mounted to the development frame 30, and FIG. 3 illustrates a state in which the cover frame 40 is not mounted to the development frame 30. Note that a configuration of the development frame 30 (as a single unit) will be described below in details in conjunction with FIG. 6.

The developing container 50 has an opening provided in a position corresponding to the developing region where the developing sleeve 70 faces the photosensitive drum 1. The developing sleeve 70 is arranged rotatably with respect to the developing container 50 such that a part of the developing sleeve 70 is exposed on the opening of the developing container 50. A bearing 71 as a bearing part is provided in each of both ends of the developing sleeve 70.

The inside of the developing container 50 is partitioned (divided) into a development chamber 31 as a first chamber and an agitation chamber 32 as a second chamber by a vertically extending partition wall 38. The development chamber 31 and the agitation chamber 32 are connected to each other in both longitudinal ends through two communicating portions 39 of the partition wall 38. For this reason, the developer can communicate between the development chamber 31 and the agitation chamber 32 via the communicating portions 39. The development chamber 31 and the agitation chamber 32 are arranged side by side in the left and right sides of the horizontal direction.

A plurality of magnetic poles is provided along a rotational direction of the developing sleeve 70 inside the developing sleeve 70. A magnet roll as a magnetic field generating unit that generates a magnetic field for bearing the developer is fixedly disposed on a surface of the developing sleeve 70. The developer of the development chamber 31 is pumped up by the magnetic field generated by the magnetic pole of the magnet roll and is supplied to the developing sleeve 70. Since the developer is supplied from the development chamber 31 to the developing sleeve 70 in this manner, the development chamber 31 is also referred to as a supply chamber.

A first conveyance screw 33 as a conveyance unit that agitates and conveys the developer inside the development chamber 31 is disposed in the development chamber 31 to face the developing sleeve 70. The first conveyance screw 33 has a rotational shaft 33*a* as a rotatable shaft portion and a spiral blade portion 33*b* as a developer conveyance portion provided along an outer periphery of the rotational shaft 33*a*. The first conveyance screw 33 is supported rotatably with respect to the developing container 50. Each of both ends of the rotational shaft 33*a* has a bearing part.

A second conveyance screw 34 as a conveyance unit that agitates the developer inside the agitation chamber 32 and conveys the developer reversely to the first conveyance screw 33 is disposed inside the agitation chamber 32. The second conveyance screw 34 has a rotational shaft 34*a* as a rotatable shaft portion and a spiral blade portion 34*b* as a developer conveyance portion provided along an outer periphery of the rotational shaft 34*a*. The second conveyance screw 34 is supported rotatably with respect to the developing container 50. Each of both ends of the rotational shaft 34*a* has a bearing part. In addition, as the first and second conveyance screws 33 and 34 are rotatably driven, a circulation path is formed, in which the developer is circulated between the development chamber 31 and the agitation chamber 32 via the communicating portion 39.

A regulation blade (hereinafter, referred to as a doctor blade 36) as a developer regulation member that regulates the amount of the developer (also referred to as a developer coat amount) borne on the surface of the developing sleeve 70 is mounted to the developing container 50 so as to face the surface of the developing sleeve 70 without making contact. The doctor blade 36 has a coat amount regulation face 36*r* as a regulating portion for regulating the amount of the developer borne on the surface of the developing sleeve 70. The doctor blade 36 is a resin-based doctor blade molded from resin. Note that a configuration of the doctor blade 36 (as a single unit) will be described below with reference to FIG. 5.

The doctor blade 36 is arranged to face the developing sleeve 70 by interposing a predetermined gap (hereinafter, referred to as a SB gap G) with the developing sleeve 70 in a longitudinal direction of the developing sleeve 70 (that is, a direction parallel to the rotational axis of the developing sleeve 70). According to the present invention, the SB gap G is a shortest distance between a largest image region of the developing sleeve 70 and a largest image region of the doctor blade 36. Note that the largest image region of the developing sleeve 70 refers to a region of the developing sleeve 70 corresponding to the largest image region out of image regions that can form an image of the surface of the photosensitive drum 1 in the rotational axis direction of the developing sleeve 70. In addition, the largest image region of the doctor blade 36 is a region of the doctor blade 36 corresponding to the largest image region out of image regions that can form an image on the surface of the photosensitive drum 1 in parallel with the rotational axis of the developing sleeve 70. According to the first embodiment, the photosensitive drum 1 can form a plurality of sizes of electrostatic latent images. Therefore, it is assumed that the largest image region refers to an image region corresponding to the largest size (for example, A3 size) out of a plurality of sizes of image regions that can be formed on the photosensitive drum 1. Meanwhile, in a modification in which the photosensitive drum 1 can form the electrostatic latent image having only one size, it is assumed that the largest image region having one size that can be formed on the photosensitive drum 1.

The doctor blade 36 is arranged to substantially face a peak position of the magnetic flux density of the magnetic pole of the magnet roll. The developer supplied to the developing sleeve 70 is influenced by the magnetic field caused by the magnetic pole of the magnet roll. In addition, the developer regulated and scraped off by the doctor blade 36 tends to easily stay at an upstream part of the SB gap G As a result, a developer reservoir is formed in the upstream side of the doctor blade 36 in the rotational direction of the developing sleeve 70. A part of the developer in the developer reservoir is conveyed so as to pass through the SB gap G as the developing sleeve 70 rotates. In this case, a layer thickness of the developer passing through the SB gap G is regulated by the coat amount regulation face 36*r* of the doctor blade 36. In this manner, a thin layer of the developer is formed on the surface of the developing sleeve 70.

A predetermined amount of the developer borne on the surface of the developing sleeve 70 is conveyed to the developing region as the developing sleeve 70 rotates. Therefore, by adjusting the size of the SB gap G, the amount of the developer conveyed to the developing region is adjusted. According to the first embodiment, a target size of the SB gap G (so called a target value of the SB gap G) for adjusting the size of the SB gap G is set to approximately 300 μm.

The developer conveyed to the developing region magnetically rises in the developing area to form a magnetic brush. As this magnetic brush makes contact with the photosensitive drum 1, the toner of the developer is supplied to the photosensitive drum 1. Then, the electrostatic latent image formed on the surface of the photosensitive drum 1 is developed as a toner image. The developer on the surface of the developing sleeve 70 after the toner passing through the developing region is supplied to the photosensitive drum 1 (hereinafter, referred to as a developer subjected to the developing process) is scraped off from the surface of the developing sleeve 70 by virtue of a repulsive magnetic field formed between magnetic poles having the same polarity in the magnet roll. The developer after the developing step peeled off from the surface of the developing sleeve 70 is collected into the development chamber 31 by falling into the development chamber 31.

As illustrated in FIG. 4, the development frame 30 has a developer guide portion 35 provided to guide and convey the developer toward the SB gap G. The developer guide portion 35 and the development frame 30 are integrally formed, and the developer guide portion 35 and the doctor blade 36 are formed separately. The developer guide portion 35 is formed inside the development frame 30 and is disposed in the upstream side of the coat amount regulation face 36*r* of the doctor blade 36 in the rotational direction of the developing sleeve 70. By stabilizing a flow of the developer using the developer guide portion 35 so as to provide a predetermined developer density, it is possible to define a weight of the developer in a position where the coat amount regulation face 36*r* of the doctor blade 36 is closest to the surface of the developing sleeve 70.

As illustrated in FIG. 4, the cover frame 40 is formed separately from the development frame 30 and is mounted to the development frame 30. In addition, the cover frame 40 covers a part of the opening of the development frame 30 such that a part of the outer peripheral surface of the developing sleeve 70 is covered over the entire area of the developing sleeve 70 in the longitudinal direction. In this case, the cover frame 40 covers a part of the opening of the development frame 30 such that the developing region facing the photosensitive drum 1 of the developing sleeve 70 is exposed. While the cover frame 40 is fixed to the development frame 30 by ultrasonic bonding, a method of fixing the cover frame 40 to the development frame 30 may include any method such as screw fastening, snap fitting, adhesion, and welding. Note that, for the cover frame 40, as illustrated in FIG. 4, the cover frame 40 may be formed as a single part (resin-molded part), or the cover frame 40 may include a plurality of parts (resin-molded parts).

(Configuration of Resin-Based Doctor Blade)

A configuration of the doctor blade 36 (as a single unit) will be described with reference to a perspective view of FIG. 5.

During an image forming operation (developing operation), a pressure of the developer (hereinafter, referred to as an agent pressure) generated from the developer flow is applied to the doctor blade 36. As the rigidity of the doctor blade 36 decreases, the doctor blade 36 tends to be more easily deformed, and the size of the SB gap G tends to change significantly when the agent pressure is applied to the doctor blade 36 during the image forming operation. During the image forming operation, the agent pressure is applied in a lateral direction of the doctor blade 36 (in the arrow direction M in FIG. 5). In this regard, in order to suppress a significant change in the size of the SB gap G during the image forming operation, it is desirable to increase a strength of the doctor blade 36 against lateral deformation by increasing the rigidity of the doctor blade 36 in the lateral direction.

Figure 5:
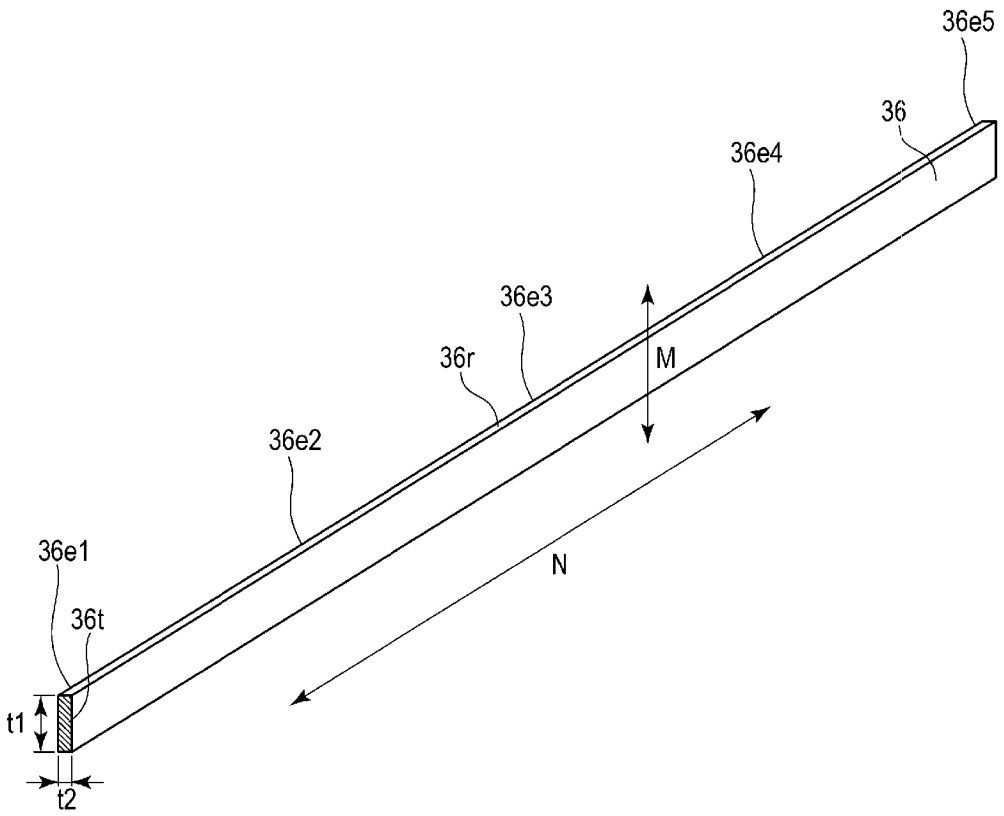
FIG. 5 is a perspective view illustrating a configuration of a resin-based doctor blade (as a single unit)

As illustrated in FIG. 5, the doctor blade 36 has a plate shape from the viewpoints of productivity and cost. In addition, as illustrated in FIG. 5, a sectional area of the side surface 36*t* of the doctor blade 36 is reduced, and a length $t_2$ in the thickness direction of the doctor blade 36 is smaller than the length $t_1$ in the lateral direction of the doctor blade 36. As a result, the doctor blade 36 (as a single unit) is more easily deformed in a direction (arrow direction M in FIG. 5) perpendicular to the longitudinal direction of the doctor blade 36 (arrow direction N in FIG. 5). In this regard, in order to correct the straightness of the coat amount regulation face 36*r*, in a state that at least a part of the doctor blade 36 is deflected in the arrow direction M of FIG. 5, the doctor blade 36 is fixed to the blade mount portion 41 of the development frame 30. Note that straightness correction of the doctor blade 36 will be described below in details with reference to FIG. 9.

(Configuration of Resin-Based Development Frame)

Figure 6:
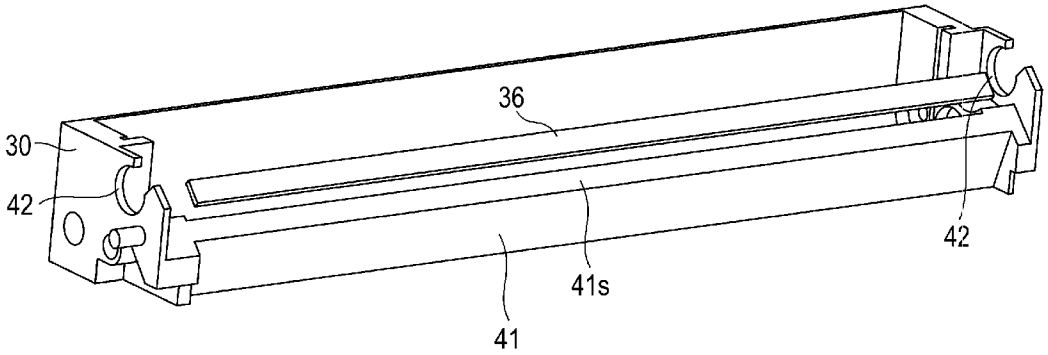
FIG. 6 is a perspective view illustrating a configuration of a resin-based development frame (as a single unit)

A configuration of the development frame 30 (as a single unit) will be described with reference to a perspective view of FIG. 6. FIG. 6 illustrates a state in which the cover frame 40 is not mounted to the development frame 30.

The development frame 30 has a development chamber 31 and an agitation chamber 32 partitioned by the development chamber 31 and the partition wall 38. The partition wall 38 is molded from resin, may be formed separately from the development frame 30, or may be formed integrally with the development frame 30.

The development frame 30 has a sleeve support portion 42 for rotatably supporting the developing sleeve 70 by supporting the bearings 71 provided in both ends of the developing sleeve 70. In addition, the development frame 30 is formed integrally with the sleeve support portion 42 and has a blade mount portion 41 for mounting the doctor blade 36. FIG. 6 illustrates a virtual state in which the doctor blade 36 is floated from the blade mount portion 41.

The doctor blade 36 is fixed to the blade mount portion 41 by curing an adhesive A applied to the blade mount face 41*s* of the blade mount portion 41 in a state that the doctor blade 36 is mounted to the blade mount portion 41.

(Rigidity of Resin-Based Doctor Blade)

The rigidity of the doctor blade 36 (as a single unit) will be described with reference to a schematic view of FIG. 7. The rigidity of the doctor blade 36 (as a single unit) is measured in a state that the doctor blade 36 is not fixed to the blade mount portion 41 of the development frame 30.

Figure 7:
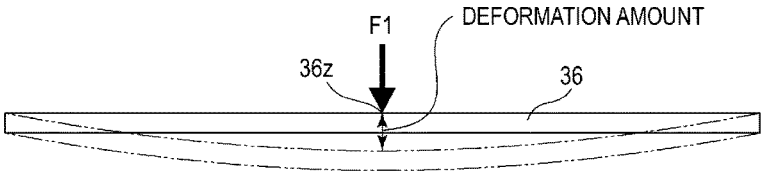
FIG. 7 is a schematic diagram for describing rigidity of the resin-based doctor blade (as a single unit)

As illustrated in FIG. 7, a concentrated load F1 is applied to a longitudinal center portion 36*z* of the doctor blade 36 in the lateral direction of the doctor blade 36. In this case, the rigidity of the doctor blade 36 (as a single unit) is measured on the basis of a lateral bending amount of the doctor blade 36 in the center portion 36*z* of the doctor blade 36.

For example, it is assumed that a concentrated load F1 of 300 gf is applied in the lateral direction of the doctor blade 36 to the longitudinal center portion 36*z* of the doctor blade 36. In this case, a bending amount of the doctor blade 36 in the lateral direction at the center portion 36*z* of the doctor blade 36 is equal to or longer than 700 μm. In this case, a deformation amount of the center portion 36*z* of the doctor blade 36 on the cross section is equal to or smaller than 5 μm.

(Rigidity of Resin-Based Development Frame)

The rigidity of the development frame 30 (as a single unit) will be described with reference to a schematic diagram of FIG. 8. The rigidity of the development frame 30 (as a single unit) is measured in a state that the doctor blade 36 is not fixed to the blade mount portion 41 of the development frame 30.

Figure 8:
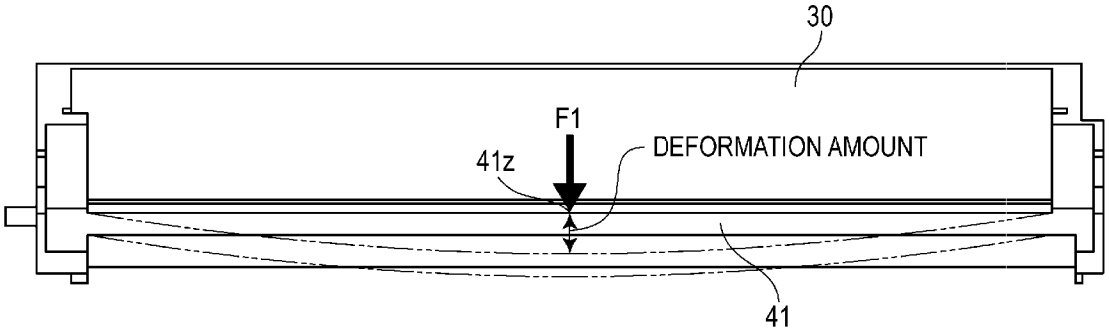
FIG. 8 is a schematic diagram for describing rigidity of the resin-based development frame (as a single unit)

As illustrated in FIG. 8, a concentrated load F1 is applied to a longitudinal center portion 41*z* of the blade mount portion 41 in the lateral direction of the blade mount portion 41. In this case, the rigidity of the development frame 30 (as a single unit) is measured on the basis of a lateral bending amount of the blade mount portion 41 in the center portion 41*z* of the blade mount portion 41.

For example, it is assumed that a concentrated load F1 of 300 gf is applied to the longitudinal center portion 41*z* of the blade mount portion 41 in the lateral direction of the blade mount portion 41. In this case, a lateral bending amount of the blade mount portion 41 in the center portion 41*z* of the blade mount portion 41 is equal to or shorter than 60 μm.

It is assumed that a concentrated load F1 of the same strength is applied to the center portion 36*z* of the doctor blade 36 and the center portion 41*z* of the blade mount portion 41 of the development frame 30. In this case, a bending amount of the center portion 36*z* of the doctor blade 36 is 10 times or more the bending amount of the center portion 41*z* of the blade mount portion 41. Therefore, the rigidity of the development frame 30 (as a single unit) is ten times or higher than that of the doctor blade 36 (as a single unit). For this reason, in a state that the doctor blade 36 is mounted to the blade mount portion 41 of the development frame 30, and the doctor blade 36 is fixed to the blade mount portion 41 of the development frame 30, the rigidity of the development frame 30 becomes dominant relative to the rigidity of the doctor blade 36. In addition, when the doctor blade 36 is fixed to the development frame 30 over the entire area of the largest image region, the rigidity of the doctor blade 36 in a state that the development frame 30 is fixed increases, as compared to a case where only both longitudinal ends of the doctor blade 36 are fixed.

The rigidity of the development frame 30 (as a single unit) is higher than the rigidity of the cover frame 40 (as a single unit). Therefore, in a state that the cover frame 40 is mounted to the development frame 30, and the cover frame 40 is fixed to the development frame 30, the rigidity of the development frame 30 becomes dominant relative to the rigidity of the cover frame 40.

(Straightness Correction of Resin-Based Doctor Blade)

As the width of the sheet S for forming the image increases to an A3 size or the like, a length of the largest image region out of the image regions where image can be formed on the surface of photosensitive drum 1 increases in a direction parallel to the rotational axis of the developing sleeve 70. For this reason, as the width of the sheet S for forming an image increases, the length of the largest image region of the doctor blade 36 increases. When the doctor blade having a large longitudinal length is molded from resin, it is difficult to guarantee straightness of the coat amount regulation face of the resin-based doctor blade molded from resin. This is because, in a case where the doctor blade having a large longitudinal length is molded from resin, a place delayed from the place where the thermal shrinkage progresses easily occurs depending on the longitudinal position of the doctor blade when the thermally expanded resin is thermally shrunken.

For this reason, in the resin-based doctor blade, as the longitudinal length of the doctor blade increases, the SB gap of the longitudinal direction of the developer bearing member tends to change due to the straightness of the coat amount regulation face 36*r* of the doctor blade. If the SB gap of the longitudinal direction of the developer bearing member is different, the amount of the developer borne on the surface of the developer bearing member in the longitudinal direction of the developer bearing member may be deviated.

For example, assuming that a resin-based doctor blade having a longitudinal length corresponding to the A3 size (hereinafter, referred to as an A3-sized resin-based doctor blade) is manufactured with precision of a typical resin-molded part, the straightness of the coat amount regulation face 36*r* becomes approximately 300 to 500 μm. In addition, even when the A3-sized resin-based doctor blade is manufactured with high precision using a high-precision resin material, the straightness of the coat amount regulation face 36*r* is approximately 100 to 200 μm.

According to the first embodiment, a size of the SB gap G is set to approximately 300 μm, and a tolerance of the SB gap G (that is, tolerance to the target value of the SB gap G) is set to ±10% or less. Therefore, according to the first embodiment, the adjustment range of the SB gap G is set to 300 μm±30 μm, which means that the tolerance of the SB gap G is up to 60 μm. For this reason, even when the A3-sized resin-based doctor blade is manufactured with high precision of a general resin molded part, or even when the A3-sized resin-based doctor blade is manufactured with high precision using a high-precision resin material, the precision of the straightness of the coat amount regulation face 36*r* exceeds an allowable range as the tolerance of the SB gap G.

Regardless of the straightness of the coat amount regulation surface, in the developing device having the resin-based doctor blade, it is desirable to set the SB gap G within a predetermined range in a direction parallel to the rotational axis of the developer bearing member in a state that the doctor blade is fixed to the mount portion of the development frame. In this regard, according to the first embodiment, even when a resin-based doctor blade having low straightness on the coat amount regulation face is employed, the straightness of the coat amount regulation face 36*r* is corrected such that the SB gap G is within a predetermined range across a direction parallel to the rotational axis of the developing sleeve 70 in a state that the doctor blade is fixed to the mount portion of the development frame.

Here, the straightness of the coat amount regulation face 36*r* of the doctor blade 36 will be described with reference to the schematic diagram of FIG. 9. The straightness of the coat amount regulation face 36*r* is defined as an absolute value of a difference between the maximum value and the minimum value of the exterior shape of coat amount regulation face 36*r* with reference to a predetermined place of the coat amount regulation face 36*r* in the longitudinal direction of the coat amount regulation face 36*r*. For example, a center portion of the coat amount regulation face 36*r* in the longitudinal direction of the coat amount regulation face 36*r* is set as the origin of the orthogonal coordinate system, a predetermined straight line passing through the origin is set as the X-axis, and a straight line drawn from the origin at the right angle with respect to the X-axis the Y-axis is set as the Y-axis. In this orthogonal coordinate system, the straightness of the coat amount regulation face 36*r* is represented by an absolute value of the difference between the maximum value and the minimum value of the Y coordinate of the exterior shape of the coat amount regulation face 36*r*.

Figure 9:
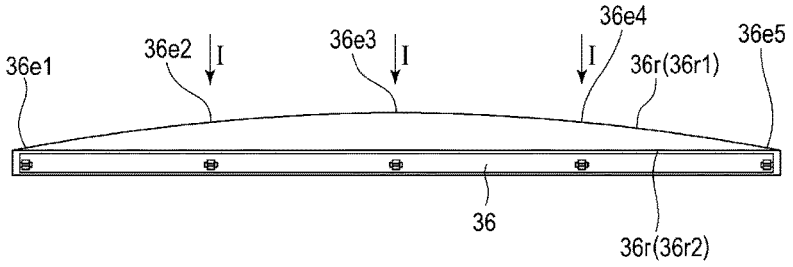
FIG. 9 is a schematic diagram for describing straightness of the resin-based doctor blade (as a single unit)

As illustrated in FIG. 9, in the resin-based doctor blade (as a single unit), the center portion of the coat amount regulation face 36*r* of the doctor blade 36 is significantly bent in the longitudinal direction of the doctor blade 36. For this reason, it is necessary to correct the straightness of the doctor blade 36 by reducing a positional difference of the leading end portion 36*e* (36*e* 1 to 36*e*5) of the doctor blade 36 illustrated in FIG. 5. It is necessary to correct the straightness of the coat amount regulation face 36*r* of the doctor blade 36 to 50 μm or less in consideration of an allowable value of the tolerance of the SB gap G and the mounting precision of the doctor blade 36 to the development frame 30. Considering a fact that accuracy of straightness of the metal-based doctor blade is 20 μm or smaller by a secondary cutting process, the straightness of the coat amount regulation face 36*r* of the resin-based doctor blade 36 is more desirably corrected to 20 μm or smaller. Considering a realistic mass production process, a setting value of straightness correction of the coat amount regulation face 36*r* of the doctor blade 36 is set to approximately 20 to 50 μm.

In this regard, a force of bending at least a part of the largest image region of the doctor blade 36 (also referred to as a straightness correction force) is applied to the doctor blade 36 to bend at least a part of the largest image region of the doctor blade 36. As a result, the straightness of the coat amount regulation face 36*r* of the doctor blade 36 is corrected to 50 μm or smaller.

In the example of FIG. 9, the straightness correction force is applied to the leading end portions 36*e*2, 36*e*3, and 36*e*4 as indicated by the arrow direction I of FIG. 9 such that the exterior shapes of the leading end portions 36*e*2, 36*e*3, and 36*e*4 are aligned with respect to the exterior shapes of the leading end portions 36*e*1 and 36*e*5 of the doctor blade 36. As a result, the shape of the coat amount regulation face 36*r* of the doctor blade 36 is corrected from the coat amount regulation face 36*r*1 to the coat amount regulation face 36*r*2. Therefore, it is possible to correct the straightness of the coat amount regulation face 36*r* of the doctor blade 36 to 50 μm or smaller. Note that, although a reference for aligning the exterior shape of the leading end portion 36*e* of the doctor blade 36 is set to the exterior shapes of the leading end portions 36*e*1 and 36*e*5 (both longitudinal ends of the coat amount regulation face 36*r*) in the example of FIG. 9, the reference may be set to the exterior shapes of the leading end portion 36*e*3 (longitudinal center portion of the coat amount regulation face 36*r*). In this case, the straightness correction force is applied to the doctor blade 36 such that the exterior shapes of the leading end portions 36*e*1, 36*e*2, 36*e*4, and 36*e*5 are aligned with respect to the exterior shapes of the leading end portion 36*e*3 of the doctor blade 36.

In order to perform straightness correction of the doctor blade 36 in this manner, it is necessary to reduce the rigidity of the doctor blade (as a single unit) such that at least a part of the largest image region of the coat amount regulation face 36*r* is bent when the straightness correction force is applied to the doctor blade 36.

(Method of Adjusting SB Gap)

Adjustment of the SB gap G is performed by moving the position of the doctor blade 36 with respect to the development frame 30 so as to adjust a relative position of the doctor blade 36 mounted to the blade mount portion 41 with respect to the developing sleeve 70 supported by the sleeve support portion 42. In a predetermined position of the blade mount portion 41 determined by adjusting the SB gap G, the doctor blade 36 bent in at least a part of the largest image region is fixed using the adhesive A applied to across the entire area of the largest image region of the blade mount face 41*s* in advance. Note that the largest image region of the blade mount face 41*s* is a region of the blade mount face 41*s* corresponding to the largest image region out of the image regions that can be formed on the surface of the photosensitive drum 1 in a direction parallel to the rotational axis of the developing sleeve 70. In this case, the region bent to correct the straightness of the coat amount regulation face 36*r* out of the largest image region of the doctor blade 36 is fixed to the blade mount portion 41. Note that, if a region receiving a force of bending at least a part of the largest image region of the doctor blade 36 is fixed to the blade mount portion 41 by the adhesive A, the adhesive A may not applied to a part of the blade mount face 41*s*. In this regard, if the adhesive A is applied across the entire area of the largest image region of the blade mount face 41*s*, the following conditions are satisfied. That is, the adhesive A is applied to an area of 95% or more of the largest image region of the blade mount face 41*s*, including the region bent to correct the straightness of the coat amount regulation face 36*r* out of the region corresponding to the largest image region of the doctor blade 36.

As a result, it is possible to suppress the region bent to correct the straightness of the coat amount regulation face 36*r* out of the largest image region of the doctor blade 36 from being recovered from the bent state to the unbent original state. As a result, the doctor blade 36 is fixed to the blade mount portion 41 in a state that the straightness of the coat amount regulation face 36*r* is corrected to 50 μm or smaller.

Note that the size of the SB gap G is measured (calculated) in the following way. Note that the size of the SB gap G is measured in a state that the developing sleeve 70 is supported by the sleeve support portion 42 of the development frame 30, the doctor blade 36 is mounted to the blade mount portion 41 of the development frame 30, and the cover frame 40 is fixed to the development frame 30.

In order to measure the size of the SB gap G, a light source (such as an LED array and a light guide) is inserted into the development chamber 31 along the longitudinal direction of the development chamber 31. The light source inserted into the development chamber 31 irradiates light from the inside of the development chamber 31 to the SB gap G. In addition, a camera for photographing light rays emitted from the SB gap G to the outside of the development frame 30 is disposed in each of five places corresponding to the leading end portions 36*e* (36*e* 1 to 36*e*5) of the doctor blade 36.

In order to measure the positions of the leading end portions 36*e* (36*e*1 to 36*e*5) of the doctor blade 36, the cameras disposed in the five places photograph the light rays emitted from the SB gap G to the outside of the development frame 30. In this case, the camera reads a position where the developing sleeve 70 comes closest to the doctor blade 36 on the surface of the developing sleeve 70 and the leading end portion 36*e* (36*e* 1 to 36*e*5) of the doctor blade 36. Subsequently, the size of the SB gap G is calculated by converting the pixel value to the distance from the image data read and created using the camera. If the size of the calculated SB gap G is not within a predetermined range, the SB gap G is adjusted. If the size of the calculated SB gap G is within the predetermined range, it is determined as a position for fixing the doctor blade 36 bent at least in a part of the largest image region to the blade mount portion 41 of the development frame 30.

Note that whether or not the SB gap G is within a predetermined range in a direction parallel to the rotational axis of the developing sleeve 70 is determined on the basis of the following method. First, the largest image region of the doctor blade 36 is divided into four or more segments at equal intervals, and the SB gap G is measured at five or more places in each segment of the doctor blade 36 (including both ends and the center portion of the largest image region of the doctor blade 36). Then, a maximum value of the SB gap G, a minimum value of the SB gap G, and a median value of the SB gap G are extracted from the samples of the measurement value of the SB gap G measured at five or more places.

In this case, it is desirable that an absolute value of the difference between the maximum value of the SB gap G and the median value of the SB gap G is equal to smaller than 10% of the median value of the SB gap G, and an absolute value of the difference between the minimum value of the SB gap G and the median value of the SB gap G is equal to or smaller than 10% of the median value of the SB gap G. In this case, it is assumed that the tolerance of the SB gap G is equal to or smaller than ±10%, and the SB gap G is within a predetermined range in a direction parallel to the rotational axis of the developing sleeve 70. For example, if the median value of the SB gap G is 300 μm from the sample of the measurement value of the SB gap G measured at five or more places, the maximum value of the SB gap G may be set to 330 μm or smaller, and the minimum value of the SB gap G may be set to 270 μm or larger. That is, in this case, the adjustment range of the SB gap G is 300 μm±30 μm, and the tolerance of the SB gap G (that is, the tolerance to the target value of the SB gap G) is allowable up to 60 μm.

(Linear Expansion Coefficient)

Subsequently, deformation generated in the doctor blade 36 and the development frame 30 caused by a temperature change due to the heat generated during the image forming operation will be described with reference to the perspective view of FIG. 10. The heat generated during the development operation includes, for example, heat generated when the rotational shaft of the developing sleeve 70 and the bearing 71 are rotated, heat generated when the rotational shaft 33*a* of the first conveyance screw 33 and its bearing part are rotated, or heat generated when the developer passes through the SB gap G, and the like. A temperature around the developing device 3 changes by such heat generated during the image forming operation, so that the temperature of the doctor blade 36, the development frame 30, or the cover frame 40 also changes.

Figure 10:
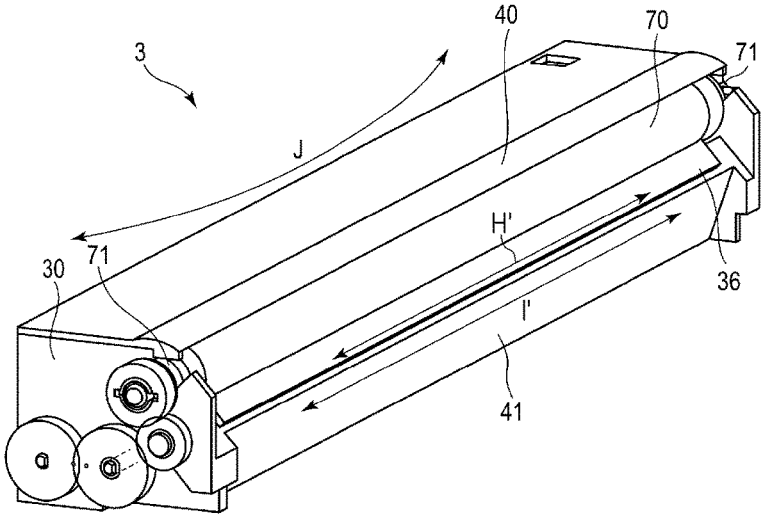
FIG. 10 is a perspective view for describing deformation of the resin-based doctor blade due to a temperature change.

As illustrated in FIG. 10, an elongation amount of the doctor blade 36 caused by a temperature change is set to H' [μm], and an elongation amount of the blade mount face 41*s* of the blade mount portion 41 of the development frame 30 is set to I' [μm]. In addition, it is assumed that a linear expansion coefficient α1 of the resin of the doctor blade 36 is different from a linear expansion coefficient α2 of the resin of the development frame 30. In this case, a deformation amount caused by a temperature change is different between the development frame 30 and the doctor blade 36 due to the difference of the linear expansion coefficient. In order to compensate for the difference between H' [μm] and I' [μm], the doctor blade 36 is deformed in the arrow direction J of FIG. 10. Hereinafter, deformation of the doctor blade 36 in the arrow direction J in FIG. 10 is referred to as deformation of the bending direction of the doctor blade 36. In addition, deformation of the doctor blade 36 in the bending direction causes a variation in the size of the SB gap G. In order to suppress a change of the size of the SB gap G caused by heat, each of the linear expansion coefficient α2 of the resin of the sleeve support portion 42 and the blade mount portion 41 of the development frame 30 (as a single unit) and the linear expansion coefficient α1 of resin of the doctor blade 36 (as a single unit) are related. That is, when the linear expansion coefficient α1 of the resin of the doctor blade 36 and the linear expansion coefficient α2 of the resin of the development frame 30 are different, the deformation amount caused by the temperature change is different depending on such a difference of the linear expansion coefficient.

In general, a resin material has a linear expansion coefficient larger than that of a metal material. When the doctor blade 36 is made of resin, warping deformation occurs in the doctor blade 36 due to a temperature change caused by heat generated during the image forming operation, and the longitudinal center portion of the doctor blade 36 is easily bent. As a result, in the developing device in which the resin-based doctor blade 36 is fixed to the resin-based development frame, the size of the SB gap G easily changes as the temperature changes during the image forming operation.

At least a part of the largest image region of the doctor blade 36 is bent to correct the straightness of the coat amount regulation face 36*r* to 50 μm or smaller. In addition, the doctor blade 36 bent in at least a part of the largest image region is fixed to the blade mount portion 41 of the development frame 30 across the entire area of the largest image region of the doctor blade 36 using an adhesive A.

In this case, when there is a large difference between the linear expansion coefficient α2 of the resin of the development frame 30 and the linear expansion coefficient α1 of the resin of the doctor blade 36, the following problem occurs when a temperature change occurs. That is, when a temperature change occurs, the deformation amount (expansion/contraction amount) of the doctor blade 36 caused by the temperature change is different from the deformation amount (expansion/contraction amount) of the development frame 30 caused by the temperature change. As a result, even when the SB gap G is adjusted with high precision to determine a position where the doctor blade 36 is mounted to the blade mount face 41*s* of the development frame 30, the size of the SB gap G changes due to a temperature change during the image forming operation.

Since the doctor blade 36 is fixed to the blade mount face 41*s* across the entire area of the largest image region, it is necessary to suppress a change of the size of the SB gap G caused by the temperature change during the image forming operation. In order to suppress a deviation in the amount of the developer borne on the surface of the developing sleeve 70 in the longitudinal direction of the developing sleeve 70, it is generally necessary to suppress a variation of the SB gap G caused by heat to ±20 μm or smaller.

A difference between the linear expansion coefficient α1 of the resin of the doctor blade 36 and the linear expansion coefficient α2 of the resin of the development frame 30 having the sleeve support portion 42 and the blade mount portion 41 is hereinafter referred to as a linear expansion coefficient difference $\alpha 2-\alpha 1$. A maximum bending amount change of the doctor blade 36 caused by this linear expansion coefficient $\alpha 2-\alpha 1$ will be described with reference to Table 1. The maximum bending amount of the doctor blade 36 was measured by applying a temperature change from a room temperature (23° C.) to a high temperature (40° C.) in a state that the doctor blade 36 is fixed to the blade mount portion 41 of the development frame 30 across the entire area of the largest image region of the doctor blade 36.

It is assumed that the linear expansion coefficient of the resin of the development frame 30 having the sleeve support portion 42 and the blade mount portion 41 is set to αb 2 [m/° C.], and the linear expansion coefficient of the resin of the doctor blade 36 is set to $\alpha 1$ [m/° C.]. In addition, the maximum bending amount of the doctor blade 36 was measured by changing a parameter of the linear expansion coefficient difference $\alpha 2-\alpha 1$. The result is shown in Table 1. In Table 1, if an absolute value of the maximum bending amount of the doctor blade 36 is equal to or smaller than 20 μm, the maximum bending amount is denoted by "O". If an absolute value of the maximum bending amount of the doctor blade 36 is larger than 20 μm, the maximum bending amount is denoted by "X".

TABLE 1

| | Linear expansion coefficient difference $\alpha 2-\alpha 1$ [$\times 10^{-5}$ m/° C.] | | | | | | | | |
|---|---|---|---|---|---|---|---|---|---|
| | 0 | +0.20 | +0.40 | +0.50 | +0.54 | +0.55 | +0.56 | +0.57 | +0.60 |
| Maximum bending amount of doctor blade | ○ | ○ | ○ | ○ | ○ | ○ | x | x | x |
| | Linear expansion coefficient difference $\alpha 2-\alpha 1$ [$\times 10^{-5}$ m/° C.] | | | | | | | | |
| | 0 | −0.20 | −0.40 | −0.44 | −0.45 | −0.46 | −0.47 | −0.50 | |
| Maximum bending amount of doctor blade | ○ | ○ | ○ | ○ | ○ | x | x | x | |

As recognized from Table 1, in order to suppress a variation of the SB gap G caused by heat to ±20 μm or smaller, it is necessary for the linear expansion coefficient difference $\alpha 2-\alpha 1$ to satisfy the following relationship (Formula 1).

$$-0.45\times10^{-5}[\text{m/° C.}]\leq\alpha 2-\alpha 1\leq 0.55\times10^{-5}[\text{m/° C.}] \quad \text{(Formula 1)}$$

In this regard, the resin of the development frame 30 and the resin of the doctor blade 36 may be selected such that the linear expansion coefficient difference $\alpha 2-\alpha 1$ is equal to or larger than $-0.45\times10^{-5}$[m/° C.] and equal to or smaller than $0.55\times10^{-5}$[m/° C.]. Note that, when the same resin is selected for the development frame 30 and the doctor blade 36, the linear expansion coefficient difference $\alpha 2-\alpha 1$ becomes zero.

Note that, as the adhesive A is applied to the doctor blade 36 or the development frame 30, the linear expansion coefficient of the doctor blade 36 or the development frame 30 coated with the adhesive A changes. However, a volume of the adhesive A applied to the doctor blade 36 or the development frame 30 is very small, and influence to a dimension variation in the thickness direction of the adhesive A caused by the temperature change is negligible. For this reason, when the adhesive A is applied to the doctor blade 36 or the development frame 30, deformation in the warp direction of the doctor blade 36 caused by a change of the linear expansion coefficient difference $\alpha 2-\alpha 1$ is negligible.

Similarly, since the cover frame 40 is fixed to the development frame 30, the deformation of the cover frame 40 in the warp direction generates a change of the size of the SB gap G if a deformation amount caused by a temperature change is different between the development frame 30 and the cover frame 40. It is assumed that the linear expansion coefficient of the resin of the development frame 30 having the sleeve support portion 42 and the blade mount portion 41 is set to $\alpha 2$ [m/° C.], and the linear expansion coefficient of the resin of the cover frame 40 is set to $\alpha 3$ [m/° C.]. In addition, a difference between the linear expansion coefficient $\alpha 2$ of the resin of the development frame 30 having the sleeve support portion 42 and the blade mount portion 41 and the linear expansion coefficient $\alpha 3$ of the resin of the cover frame 40 is hereinafter referred to as a linear expansion coefficient difference $\alpha 3-\alpha 2$. In this case, it is necessary to set the linear expansion coefficient difference $\alpha 3-\alpha 2$ to satisfy the following relationship (Formula 2) as in Table 1.

$$-0.45\times10^{-5}[\text{m/° C.}]\leq\alpha 3-\alpha 2\leq 0.55\times10^{-5}[\text{m/° C.}] \quad \text{(Formula 2)}$$

In this regard, the resin of the development frame 30 and the resin of the cover frame 40 may be selected such that the linear expansion coefficient difference $\alpha 3-\alpha 2$ becomes equal to or larger than $-0.45\times10^{-5}$ [m/° C.] and equal to or smaller than $0.55\times10^{-5}$ [m/° C.]. Note that, if the same resin is selected for the development frame 30 and the cover frame 40, the linear expansion coefficient difference $\alpha 3-\alpha 2$ becomes zero.

(Agent Pressure)

Figure 11:
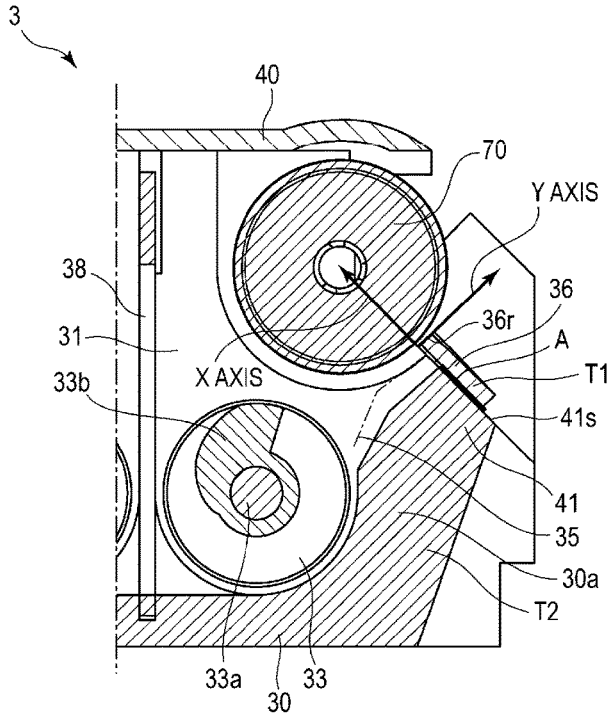
FIG. 11 is a cross-sectional view for describing deformation of the resin-based doctor blade due to an agent pressure.

Subsequently, deformation of the doctor blade 36 caused by the agent pressure generated from a developer flow during the image forming operation and applied to the doctor blade 36 will be described with reference to the cross-sectional view of FIG. 11. FIG. 11 is a cross-sectional view illustrating the developing device 3 in a cross section perpendicular to the rotational axis of the developing sleeve 70 (cross section H of FIG. 2). In addition, FIG. 11 illustrates a configuration in the vicinity of the doctor blade 36 fixed to the blade mount portion 41 of the development frame 30 using the adhesive A.

As illustrated in FIG. 11, a line obtained by connecting the nearest position of the doctor blade 36 to the developing sleeve 70 on the coat amount regulation face 36*r* and the rotational center of the developing sleeve 70 is defined as the X-axis. In this case, the doctor blade 36 has a long length in the X-axis direction, and the rigidity on the cross section of the X-axis direction increases. In addition, as illustrated in FIG. 11, a proportion of the cross-sectional area T1 of the doctor blade 36 against the cross-sectional area T2 of the wall portion 30*a* of the development frame 30 positioned in the vicinity of the developer guide portion 35 decreases.

As described above, the rigidity of the development frame 30 (as a single unit) is set to be 10 times or higher than the rigidity of the doctor blade 36 (as a single unit). Therefore, in a state that the doctor blade 36 is fixed to the blade mount portion 41 of the development frame 30, the rigidity of the development frame 30 becomes dominant relative to the rigidity of the doctor blade 36. As a result, during the image forming operation, a displacement (maximum bending amount) of the coat amount regulation face 36*r* of the doctor blade 36 when the doctor blade 36 receives the agent pressure is substantially equivalent to a displacement of the development frame 30 (maximum bending amount).

The developer pumped up from the first conveyance screw 33 during the image forming operation is conveyed to the surface of the developing sleeve 70 through the developer guide portion 35. Then, the doctor blade 36 receives the agent pressure from various directions when the layer thickness of the developer is defined to match the size of the SB gap G by the doctor blade 36. As illustrated in FIG. 11, assuming that a direction perpendicular to the X-axis direction (direction for defining the SB gap G) is set to the Y-axis direction, the agent pressure of the Y-axis direction is perpendicular to the blade mount face 41*s* of the development frame 30. That is, the agent pressure of the Y-axis direction becomes a force of detaching the doctor blade 36 from the blade mount face 41*s*. Therefore, it is necessary for a bonding force of the adhesive A to be sufficiently large relative to the agent pressure of the Y-axis direction. In this regard, considering the force of detaching the doctor blade 36 from the blade mount face 41*s* by the agent pressure or the adhesive force of the adhesive A, the adhering area or the coat thickness of the adhesive A on the blade mount face 41*s* is optimized.

(Configuration of Developing Device of First Embodiment)

As described above, the layer thickness of the developer passing through the SB gap G during the image forming operation is regulated by the coat amount regulation face of the doctor blade, and a thin layer of the developer is formed on the surface of the developing sleeve 70. In addition, a predetermined amount of the developer borne on the surface of the developing sleeve 70 is conveyed to the developing region as the developing sleeve 70 rotates. The developer conveyed to the developing region is grown on the developing region to form a magnetic brush. In addition, as the toner of the developer supplied from the magnetic brush in the developing region is supplied to the electrostatic latent image, the electrostatic latent image is developed as a toner image.

Meanwhile, a part of the toner of the developer supplied from the magnetic brush in the developing region is not attached to the electrostatic latent image in the developing region, but may be scattered from the developing region. For this reason, in particular, in a space under the developing region in the gravity direction, the amount of the toner floating in this space due to the self weight of the toner scattered from the developing region relatively increases.

In this regard, according to the first embodiment, a seal member (hereinafter, referred to as a first seal member) for capturing the toner scattered downward from the developing region in the gravity direction is mounted to the developing device so as to abut on the photosensitive drum 1. As a result, the toner scattered downward in the direction of gravity from the developing area is prevented from scattering to the outside of the apparatus. For this reason, it is necessary to provide a seal mount portion for mounting the first seal member to the developing device such that the first seal member abuts on the photosensitive drum 1 (hereinafter, referred to as a first seal mount portion) in the vicinity of the photosensitive drum 1 downward from the developing region in the gravity direction. From the viewpoint of mountability of the first seal member to the developing device, it is desirable to provide the first seal mount portion under the developing region in the gravity direction in the vicinity of the photosensitive drum 1.

Meanwhile, in the developing device according to the first embodiment, the doctor blade is arranged vertically under a position where the developing sleeve 70 is closest to the photosensitive drum 1. In such a developing device according to the first embodiment, the doctor blade is provided under the developing region in the gravity direction in the vicinity of the photosensitive drum 1. For this reason, in the developing device according to the first embodiment, a distance between the position of the doctor blade and the position of the first seal mount portion is provided tends to be close.

As described above, the developing device according to the first embodiment has the resin-based doctor blade molded from resin and the resin-based development frame molded from resin. In general, resin has a high degree of freedom in the molding, compared to metal. In this regard, in order to reduce the number of components, it is conceived that the first seal mount portion is molded integrally with the resin-based development frame. However, assuming that the first seal mount portion is integrally molded with the resin-based development frame, the mountability of the doctor blade to the development frame may be degraded as the doctor blade collides with the first seal mount portion of the development frame at the time of mounting the doctor blade to the development frame. This is particularly important when a position of the doctor blade and a position of the first seal mount portion are close to each other in a developing device in which the doctor blade is arranged vertically under a position where the developing sleeve 70 is closest to the photosensitive drum 1.

In this regard, in the developing device according to the first embodiment, the first seal mount portion is molded integrally with the resin-based doctor blade to reduce the number of components, so that the mountability of the doctor blade to the development frame is also achieved. According to the first embodiment described above, it is possible to suppress the toner scattered downward in the gravity direction from the developing region from being scattered to the outside of the apparatus without degrading the mountability of the doctor blade to the development frame using a simple configuration by which the number of components is reduced. This will be described below in details.

Figure 12:
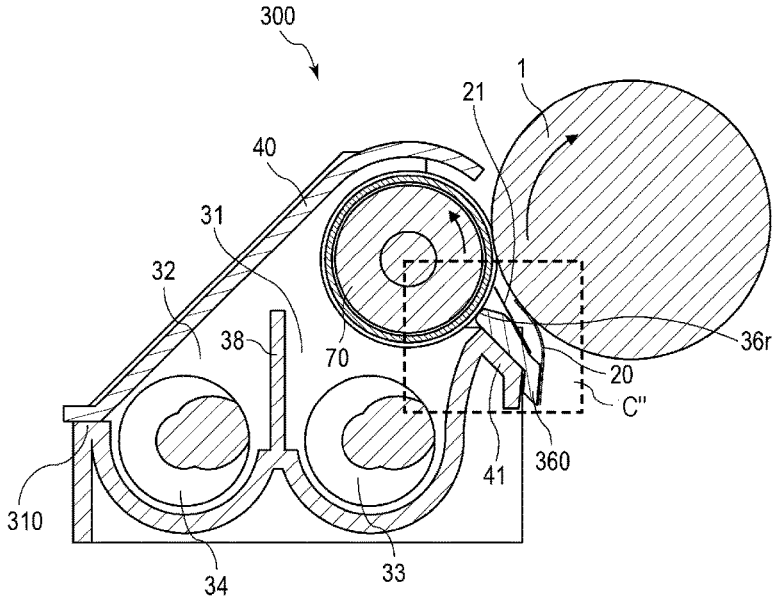
FIG. 12 is a cross-sectional view illustrating a configuration of the developing device according to a first embodiment.
Figure 13:
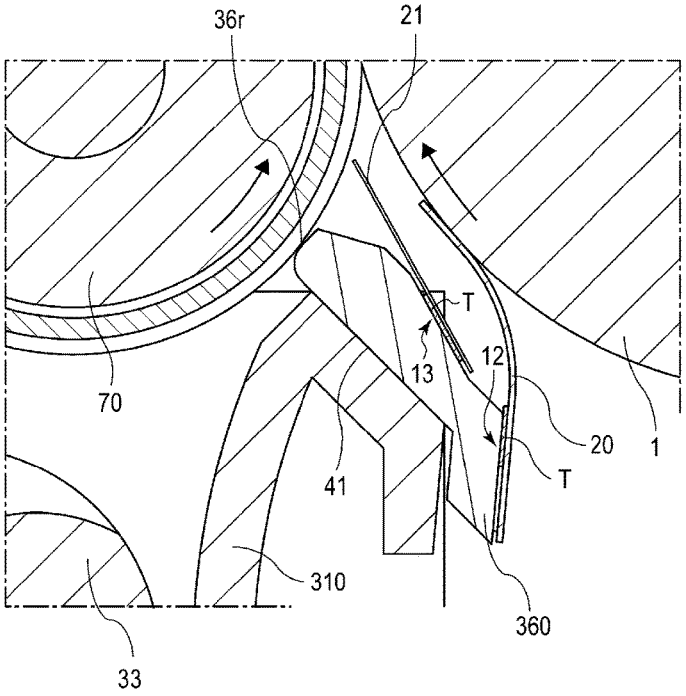
FIG. 13 is an enlarged view illustrating a configuration of the developing device according to the first embodiment.
Figure 14:
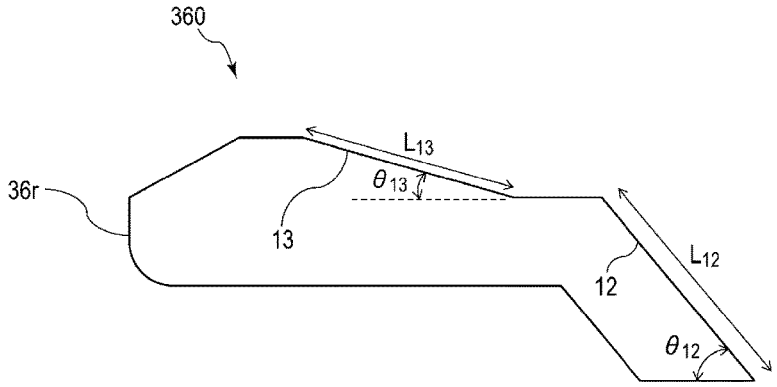
FIG. 14 is a cross-sectional view illustrating a configuration of the resin-based doctor blade (as a single unit) according to the first embodiment.

A configuration of the developing device according to the first embodiment will be described with reference to the cross-sectional view of FIG. 12 and the enlarged view of FIG. 13. In addition, a configuration of the doctor blade (doctor blade 360) according to the first embodiment will be described with reference to the cross-sectional view of FIG. 14. FIG. 12 is a cross-sectional view illustrating the developing device 300 on the cross section perpendicular to the rotational axis of the developing sleeve 70. FIG. 13 is an enlarged view illustrating the developing device 300 in the cross-sectional area C" of FIG. 12 (in the vicinity of the doctor blade 360). FIG. 14 is a cross-sectional view illustrating the doctor blade 360 on the cross section perpendicular to the longitudinal direction of the doctor blade 360.

Figure 2:
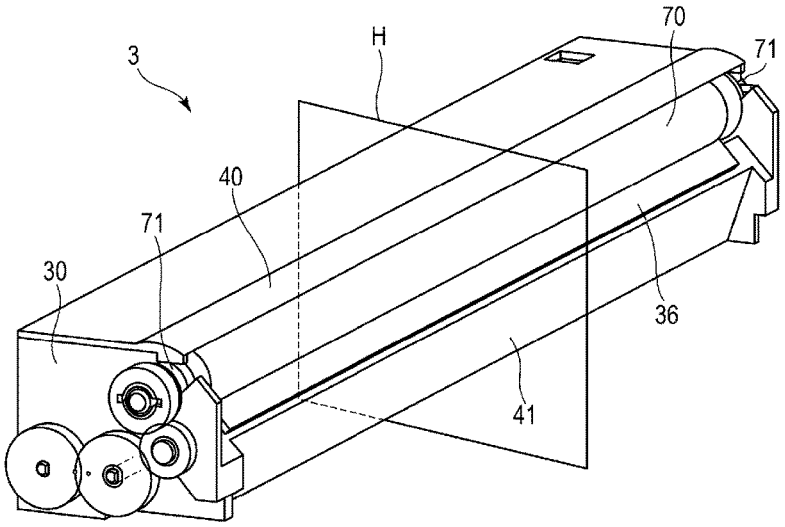
FIG. 2 is a perspective view illustrating a configuration of a developing device.
Figure 3:
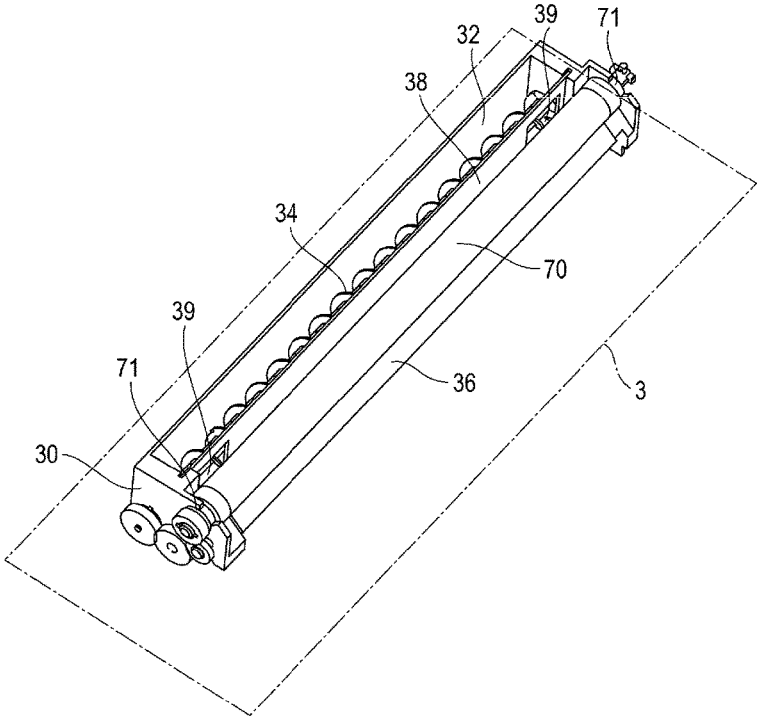
FIG. 3 is a perspective view illustrating a configuration of the developing device.
Figure 4:
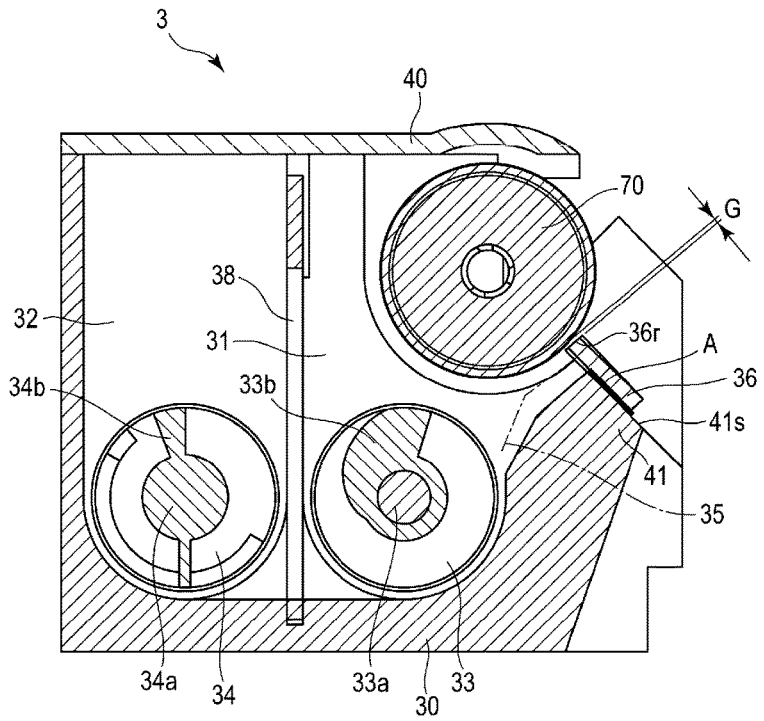
FIG. 4 is a cross-sectional view illustrating a configuration of the developing device.

In FIGS. 12 and 13, like reference numerals denote like elements as in FIGS. 2, 3, and 4. The description will be made by focusing on differences between the configuration of the developing device 300 of the first embodiment and the configuration of the developing device 3 described in conjunction with FIGS. 2, 3, and 4. In addition, in FIG. 14, like reference numerals denote like elements as in FIG. 5. In the configuration of the doctor blade 360 according to the first embodiment, the description will be made by focusing on elements different from those of the doctor blade 36 described in conjunction with FIG. 5.

As illustrated in FIGS. 12 and 13, the developing device 300 has a configuration in which the doctor blade 360 is arranged vertically under the position where the developing sleeve 70 is closest to the photosensitive drum 1. In addition, as illustrated in FIG. 14, the resin-based doctor blade 360 has a first seal mount portion 12 for mounting the first seal member 20. The first seal member 20 is a sheet member for capturing the toner scattered downward in the gravity direction from the developing region and has flexibility. The first seal member 20 is arranged to make contact with the photosensitive drum 1. In addition, the first seal member 20 makes contact with the photosensitive drum 1 across the entire area of the largest image region out of the image regions where an image can be formed on the surface of the photosensitive drum 1 with respect to the rotational axis direction of the photosensitive drum 1.

As illustrated in FIG. 13, the first seal member 20 is fixed to the first seal mount portion 12 of the doctor blade 360 with a double-sided tape T. A position where the photosensitive drum 1 makes contact with the first seal member 20 is located in the upstream side of a position where the photosensitive drum 1 is closest to the developing sleeve 70 in the rotational direction of the photosensitive drum 1 vertically under the position where the photosensitive drum 1 is closest to the developing sleeve 70. For this reason, at least a part of the space formed between the developing device 300 and the photosensitive drum 1 is sealed with the first seal member 20. That is, according to the first embodiment, the first seal member 20 is fixed to the first seal mount portion 12 of the doctor blade 360, so that the toner scattered downward in the gravity direction from the developing region is captured by the first seal member 20. Therefore, scattering of the toner to the outside of the apparatus is suppressed.

Note that, according to the first embodiment, the double-sided tape T is used as a unit for fixing the first seal member 20 to the first seal mount portion 12 of the doctor blade 360. In this regard, according to the first embodiment, a length $L_{12}$ of the plane (first seal mount face) formed in the first seal mount portion 12 is set such that an area for adhering the double-sided tape T to the first seal mount portion 12 of the doctor blade 360 is reliably secured.

According to the first embodiment, an angle $\theta_{12}$ of the first seal mount portion 12 is set such that the first seal member 20 is not recurved due to a weight of the toner captured by the first seal member 20 and deposited, even in a state that the first seal member 20 does not make contact with the photosensitive drum 1. In addition, by fixing the first seal member 20 to the first seal mount portion 12 set at the angle $\theta_{12}$, it is possible to capture the toner scattered downward in the gravity direction from the developing region and suppress the toner from be scattered to the outside of the apparatus.

As described above, according to the first embodiment, the first seal mount portion 12 is molded integrally with the resin-based doctor blade 360. For this reason, it is not necessary to interpose another member for mounting the first seal member 20 to the developing device 300 such that the first seal member 20 abuts on the photosensitive drum 1 between the first seal mount portion 12 and the doctor blade 360. Therefore, according to the first embodiment, it is possible to suppress the toner scattered downward in the gravity direction from the developing region from being scattered to the outside of the apparatus without degrading the mountability of the doctor blade 360 to the developing device 300 using a simple configuration by which the number of components is reduced.

Note that, during the image forming operation, an air flow is generated on the surface of the developing sleeve 70 as the developing sleeve 70 rotates. In addition, when the layer thickness of the developer passing through the SB gap G is regulated by the doctor blade 360, the toner held on the surface of the magnetic carrier by an electrostatic force may be separated from the surface of the magnetic carrier by this air flow in some cases. As a result, the toner scattering amount tends to increase in a region located in the downstream side from the position where the developing sleeve 70 is closest to the doctor blade 360 and in the upstream side from the position where the developing sleeve 70 is closest to the photosensitive drum 1 in the rotational direction of the developing sleeve 70.

In this regard, according to the first embodiment, a second seal mount portion 13 for mounting the second seal member 21 is molded integrally with resin-based doctor blade 360 in addition to the first seal mount portion 12 for mounting the first seal member 20. The second seal member 21 is a sheet material for capturing the toner scattered when the layer thickness of the developer passing through the SB gap G is regulated by the doctor blade 360 and has flexibility. The second seal member 21 is arranged to face the developing sleeve 70 without making contact with the developing sleeve 70. In addition, the second seal member 21 is provided, in the rotational axis direction of the developing sleeve 70, to face the developing sleeve 70 across the entire area of the developing sleeve 70 corresponding to the largest image region out of the image regions where images can be formed on the surface of the photosensitive drum 1.

As illustrated in FIG. 13, the second seal member 21 is fixed to the second seal mount portion 13 of the doctor blade 360 with a double-sided tape T. The position where the developing sleeve 70 is closest to the second seal member 21 is placed in the downstream side of the position where the developing sleeve 70 is closest to the doctor blade 360 and in the upstream side of the position where the developing sleeve 70 is closest to the photosensitive drum 1 in the rotational direction of the developing sleeve 70. For this reason, at least a part of the space formed between the developing device 300 and the photosensitive drum 1 is sealed with the second seal member 21 in addition to the first seal member 20. That is, because the second seal member 21 is fixed to the second seal mount portion 13 of the doctor blade 360, it is possible to suppress the toner scattered when the layer thickness of the developer passing through the SB gap G is regulated by the doctor blade 360 from being scattered to the outside of the apparatus.

While the first seal member 20 is disposed to make contact with the photosensitive drum 1 in order to improve the sealing property, the second seal member 21 is disposed without making contact with the developing sleeve 70 in order to prevent a change of the thickness of the thin layer of the developer formed on the surface of the developing sleeve 70. When the second seal member 21 is a sheet material having low rigidity (such as an urethane sheet), and the abutting pressure is set such that the thickness of the thin layer of the developer does not change even by making the second seal member 21 contact with the developing sleeve 70, the second seal member 21 may make contact with the developing sleeve 70. By arranging the second seal member 21 to make contact with the developing sleeve 70, it is possible to improve the sealing property.

For this reason, when the second seal member 21 is arranged to make contact with the developing sleeve 70, it is possible to further improve an effect of suppressing scattering of the toner to the outside of the apparatus, compared to a case where the second seal member 21 is arranged without making contact with the developing sleeve 70, which is advantageous. When the second seal member 21 is arranged without making contact with the developing sleeve 70, the scattered toner is not captured by the second seal member 21. In addition, even when the scattered toner passes through the gap between the second seal member 21 and the developing sleeve 70, the toner is captured by the first seal member 20.

Note that, according to the first embodiment, the double-sided tape T is employed to fix the second seal member 21 to the second seal mount portion 13 of the doctor blade 360. In this regard, according to the first embodiment, a length $L_{13}$ of the plane (second seal mount face) formed in the second seal mount portion 13 is set such that an area for adhering the double-sided tape T to the second seal mount portion 13 of the doctor blade 360 can be reliably secured. In addition, an angle $\theta_{13}$ of the second seal mount portion 13 is set such that the second seal member 21 is not recurved due to a weight of the toner captured by the second seal member 21 and deposited, even in a state that the second seal member 21 does not make contact with the developing sleeve 70. Furthermore, by fixing the second seal member 21 to the second seal mount portion 13 set at the angle $\theta_{13}$, the toner scattered when the layer thickness of the developer passing through the SB gap G is regulated by the doctor blade 360 is captured by the second seal member 21. As a result, it is possible to suppress the toner scattered when the layer thickness of the developer passing through the SB gap G is regulated by the doctor blade 360 from being scattered to the outside of the apparatus.

Alternatively, although a double-sided tape T is employed to fix the first seal member 20 to the first seal mount portion 12 of the doctor blade 360 in the first embodiment by way of example, an adhesive A may also be employed. Similarly, although the double-sided tape T is employed to fix the second seal member 21 to the second seal mount portion 13 of the doctor blade 360 in the first embodiment by way of example, an adhesive A may also be employed.

As described above, according to the first embodiment, the second seal mount portion 13 is molded integrally with the resin-based doctor blade 360. For this reason, as illustrated in FIG. 14, the thickness of the doctor blade 360 partially increases along the slope of the angle $\theta_{13}$ in a portion of the doctor blade 360 where the second seal mount portion 13 is provided, compared to a portion where the second seal mount portion 13 is not provided. In this manner, in a portion where the thickness of the resin-molded part is partially large, a difference of the thermal contraction progress rate between the inner and outer sides of the resin-molded part easily increases when the resin thermally expanded during molding is thermally contracted, compared to the other part. In addition, the molding contraction rate easily becomes ununiform. This is because the resin thermally expanded during molding is slowly cooled from the outer side of the resin-molded part making contact with a cast toward the inner side of the resin-molded part that does not make contact with the cast, so that the thermal contraction progresses. Note that, here, the portion where the thickness of the resin-molded part is partially large refers to a portion having a thickness larger than 1.2 times the basic thickness of the resin-molded part.

Therefore, in a portion of the doctor blade 360 where the second seal mount portion 13 is formed (that is, thick portion), a sink mark is easily formed on a surface of the doctor blade 360 mounted to the blade mount portion 41, compared to a portion where the second seal mount portion 13 is not formed. When the doctor blade 360 is fixed to the blade mount portion 41 using an adhesive, a portion of the doctor blade 360 where a large sink mark is formed out of the surface mounted to the blade mount portion 41 (for example, a portion having a sink mark of 50 μm) is used as an adhering face, the following problem may occur. That is, since an adherence strength varies in the longitudinal direction of the doctor blade 360 due to a variation of the sink mark on the surface of the doctor blade 360 mounted to the blade mount portion 41, it is difficult to adhere the doctor blade with a sufficient adherence strength without increasing an absolute amount of the adhesive A applied to the adhering face. As a result, the doctor blade 360 is deformed by curing shrinkage of the adhesive A, and the size of the SB gap G may vary in the longitudinal direction of the doctor blade 360.

In this regard, when the doctor blade 360 is adhered to the blade mount portion 41, it is desirable to set a portion where the sink mark is relatively small is set as the adhering face without setting a portion of the doctor blade 360 where the sink mark is relatively large out of the surface mounted to the blade mount portion 41 as the adhering face. More desirably, a portion of the doctor blade 360 where the second seal mount portion 13 is formed (that is, a portion where the thickness is partially large, and the sink mark is relatively large) is not set as the adhering face, and a portion where the second seal mount portion 13 is not formed is set as the adhering face. Similarly, it is desirable that, if a portion of the doctor blade 360 where the first seal mount portion 12 is formed is a portion where the thickness is partially large, and the sink mark is relatively large, the portion where the first seal mount portion 12 is formed is not used as the adhering face.

According to the first embodiment described above, the first seal member 20 is fixed to the first seal mount portion 12 of the doctor blade 360, and the second seal member 21 is fixed to the second seal mount portion 13 of the doctor blade 360 by way of example. In this example, at least a part of the space formed between the developing device 300 and the photosensitive drum 1 is sealed with the second seal member 21 in addition to the first seal member 20.

Meanwhile, if the first seal member 20 is fixed to the first seal mount portion 12 of the doctor blade 360, it is possible to suppress the toner from being scattered to the outside of the developing device 300 from the space formed between the developing device 300 and the photosensitive drum 1 regardless of presence or absence of the second seal member 21. Meanwhile, if the second seal member 21 is fixed to the second seal mount portion 13 of the doctor blade 360, it is possible to suppress the toner from being scattered to the outside of the developing device 300 from the space formed between the developing device 300 and the photosensitive drum 1 regardless of presence or absence of the first seal member 20. Naturally, if the first seal member 20 is fixed to the first seal mount portion 12 of the doctor blade 360, and the second seal member 21 is fixed to the second seal mount portion 13 of the doctor blade 360, it is possible to suppress the toner from being scattered to the outside of the developing device 300 from the space formed between the developing device 300 and the photosensitive drum 1.

Second Embodiment

In the first embodiment described above, the resin-based doctor blade 360 is molded separately from the resin-based development frame 310, and the resin-based doctor blade 360 has the first seal mount portion 12 and the second seal mount portion 13 by way of example.

Meanwhile, in the second embodiment, an example will be described, in which the developer regulating portion for regulating the amount of the developer borne on the surface of the developing sleeve 70 is molded integrally with the resin-based development frame 310, and the resin-based development frame 310 has the first and second seal mount portions 12 and 13.

Figure 15:
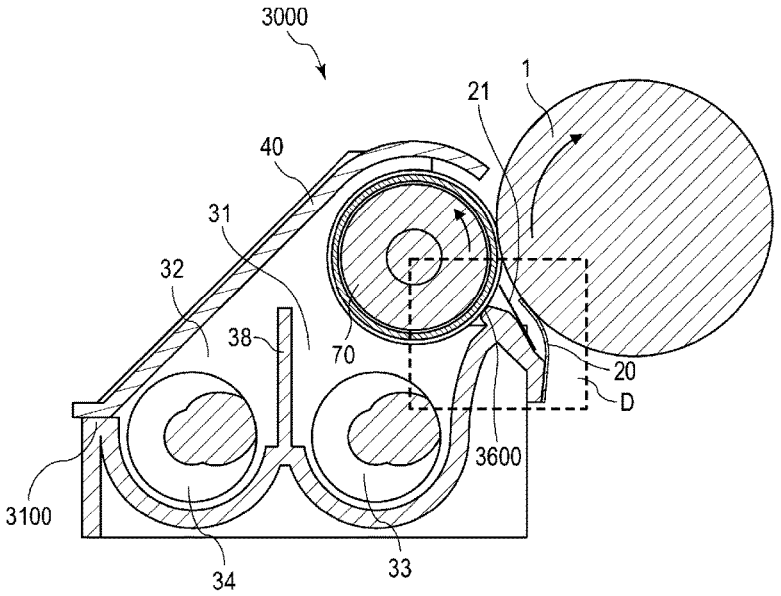
FIG. 15 is a cross-sectional view illustrating a configuration of the developing device according to a second embodiment.
Figure 16:
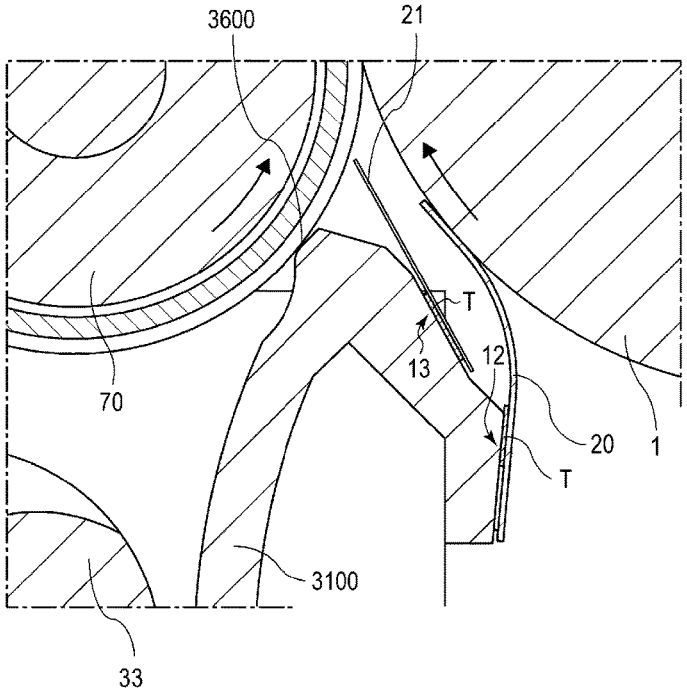
FIG. 16 is an enlarged view illustrating a configuration of the developing device according to the second embodiment.

A configuration of the developing device according to the second embodiment will be described with reference to a cross-sectional view of FIG. 15 and an enlarged view of FIG. 16. FIG. 15 is a cross-sectional view illustrating the developing device 3000 on the cross section perpendicular to the rotational axis of the developing sleeve 70. FIG. 16 is an enlarged view illustrating the developing device 3000 on the cross-sectional area D of FIG. 15 (in the vicinity of the developer regulating portion 600). In each of FIGS. 15 and 16, like reference numerals denote like elements as in FIGS. 12 and 13. The description will be made by focusing on differences between the configuration of the developing device 3000 of the second embodiment and the configuration of the developing device 300 of the first embodiment described in FIGS. 12 and 13.

As illustrated in FIGS. 15 and 16, according to the second embodiment, a development frame 3100 is molded integrally with a developer regulating portion 3600, the first seal mount portion 12, and the second seal mount portion 13. In addition, as illustrated in FIGS. 15 and 16, the developer regulating portion 3600 is disposed under a position where the developing sleeve 70 is closest to the photosensitive drum 1 in the gravity direction to face the developing sleeve 70 without making contact with the developing sleeve 70.

In the first embodiment, each of the first and second seal members 20 and 21 is fixed to the doctor blade 360. In comparison, according to the second embodiment, each of the first and second seal members 20 and 21 is fixed to the development frame 3100.

As illustrated in FIG. 16, the first seal member 20 is fixed to the first seal mount portion 12 of the development frame 3100 using a double-sided tape T. In addition, at least a part of the space formed between the developing device 3000 and the photosensitive drum 1 is sealed with the first seal member 20. That is, according to the second embodiment, since the first seal member 20 is fixed to the first seal mount portion 12 of the development frame 3100, it is possible to suppress the toner scattered downward in the gravity direction from the developing region from being scattered to the outside of the apparatus.

As illustrated in FIG. 16, the second seal member 21 is fixed to the second seal mount portion 13 of the development frame 3100 using the double-sided tape T. In addition, at least a part of the space formed between the developing device 3000 and the photosensitive drum 1 is sealed with the second seal member 21. That is, since the second seal member 21 is fixed to the second seal mount portion 13 of the development frame 3100, it is possible to suppress the toner scattered when the layer thickness of the developer passing through the SB gap G is regulated by a developer regulating portion 3600 from being scattered to the outside of the apparatus.

In this manner, according to the second embodiment, since the development frame 3100 has the developer regulating portion 3600, the first seal mount portion, and the second seal mount portion, it is possible to reduce the number of components, compared to the first embodiment. Meanwhile, according to the first embodiment, the resin-based doctor blade is molded separately from the resin-based development frame unlike the second embodiment. Therefore, it is possible to correct the straightness of the doctor blade and then fix the doctor blade to the development frame. For this reason, according to the first embodiment, by correcting the straightness of the resin-based doctor blade, the size of the SB gap G is easily adjusted to a predetermined range, compared to the second embodiment. Therefore, from the viewpoint of the precision of the SB gap G, the first embodiment is advantageous rather than the second embodiment.

Other Embodiment

The invention is not limited to the aforementioned embodiments. Various modifications (including an organical combination of respective embodiments) are possible based on the scope and spirit of the invention, and they are not excluded from the scope of the invention.

In the aforementioned embodiments, the image forming apparatus 60 has a configuration in which the intermediate transfer belt 61 is used as the intermediate transfer member as illustrated in FIG. 1 by way of example. However, the invention is not limited thereto. The invention may also be applicable to an image forming apparatus in which the recording material is sequentially transferred to the photosensitive drum 1 by directly making contact.

While the developing device 300 has been described as a single unit in the aforementioned embodiments, the same effect is obtained even in a process cartridge type in which the image forming portion 600 including the developing device 300 (refer to FIG. 1) is integrally unitized and is detachably attachable to the image forming apparatus 60. In addition, the invention may be applicable to any image forming apparatus 60 as long as it has such a developing device 300 or process cartridge regardless of a monochrome machine or a color machine.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-233793, filed Dec. 5, 2017, which is hereby incorporated by reference herein in its entirety.

What is claimed is:

1. A developing device comprising:

a developer bearing member rotatably provided to bear a developer including a toner and a carrier for developing an electrostatic latent image formed on a rotatable image bearing member;

a regulation blade made of resin and arranged to face the developer bearing member vertically under a position where the developer bearing member is closest to the image bearing member without making contact with the developer bearing member for regulating the amount of the developer borne on the developer bearing member:

a development frame made of resin and configured separately from the regulation blade to accommodate the developer, the development frame having a mount portion for mounting the regulation blade; and a sheet member, wherein the regulation blade has a sticking portion for adhering the sheet member, and when the regulation blade is mounted to the mount portion of the development frame, and the sheet member is adhered to the sticking portion of the regulation blade, the sheet member is adhered on the sticking portion so that the sheet member contacts the image bearing member at a position vertically under a developing area where an electrostatic latent image formed on the image bearing member is developed.

2. The developing device according to claim 1, further comprising another sheet member, wherein the regulation blade further has a further sticking portion for adhering the another sheet member, and when the regulation blade is mounted to the mount portion of the development frame, and the another sheet member is adhered to the further sticking portion of the regulation blade, the another sheet member is adhered on the further sticking portion so that the another sheet member faces the developer bearing member without making contact with the developer bearing member at a downstream side of a position where the developer bearing member is closest to the regulation blade and at an upstream side of a position where the developer bearing member is closest to the image bearing member with respect to a rotational direction of the developer bearing member.

3. The developing device according to claim 2, wherein the sticking portion of the regulating blade and the further sticking portion of the regulating blade are formed as a single body.

4. The developing device according to claim 1, further comprising another sheet member, wherein the regulation blade further has a further sticking portion for adhering the another sheet member, and when the regulation blade is mounted to the mount portion of the development frame, and the another sheet member is adhered to the further sticking portion of the regulation blade, the further sheet member is stuck on the further sticking portion so the another sheet member enters into the developing area where the electrostatic latent image formed on the image bearing member is developed at a downstream side of a position where the developer bearing member is closest to the regulation blade and at an upstream side of a position where the developer bearing member is closest to the image bearing member with respect to a rotational direction of the developer bearing member.

5. The developing device according to claim 3, wherein the sticking portion of the regulating blade and the further sticking portion of the regulating blade are formed as a single body.

6. The developing device according to claim 1, wherein the mount portion of the development frame is provided in a region corresponding to a maximum image region of the image bearing member, and the regulation blade is mounted, using an adhesive, to the region corresponding to the maximum image region of the image bearing member in the mount portion of the development frame.

7. The developing device according to claim 6, wherein, the regulation blade is mounted, using the adhesive, over the entirety of the region corresponding to the maximum image region of the image bearing member in the mount portion of the development frame.

8. The developing device according to claim 1, wherein the regulation blade has a rigidity capable of being flexed.

9. A developing device comprising:

a developer bearing member rotatably provided to bear a developer including a toner and a carrier for developing an electrostatic latent image formed on a rotatable image bearing member;

a regulation blade made of resin and arranged to face the developer bearing member vertically under a position where the developer bearing member is closest to the image bearing member without making contact with the developer bearing member for regulating the amount of the developer borne on the developer bearing member:

a development frame made of resin and configured separately from the regulation blade to accommodate the developer, the development frame having a mount portion for mounting the regulation blade; and a sheet member, wherein the regulation blade has a sticking portion for adhering the sheet member, and when the regulation blade is mounted to the mount portion of the development frame, and the sheet member is adhered to the sticking portion of the regulation blade, the sheet member is adhered on the sticking portion so the sheet member faces the developer bearing member without making contact with the developer bearing member at a downstream side of a position where the developer bearing member is closest to the regulation blade and at an upstream side of a position where the developer bearing member is closest to the image bearing member with respect to a rotational direction of the developer bearing member.

10. The developing device according to claim 9, wherein the mount portion of the development frame is provided in a region corresponding to a maximum image region of the image bearing member, and the regulation blade is mounted, using an adhesive, to the region corresponding to the maximum image region of the image bearing member in the mount portion of the development frame.

11. The developing device according to claim 10, wherein the regulation blade is mounted, using the adhesive, over the entirety of the region corresponding to the maximum image region of the image bearing member in the mount portion of the development frame.

12. The developing device according to claim 9, wherein the regulation blade has a rigidity capable of being flexed.

13. A developing device comprising:

a developer bearing member rotatably provided to bear a developer including a toner and a carrier for developing an electrostatic latent image formed on a rotatable image bearing member;

a regulation blade made of resin and arranged to face the developer bearing member vertically under a position where the developer bearing member is closest to the image bearing member without making contact with the developer bearing member for regulating the amount of the developer borne on the developer bearing member;

a development frame made of resin and configured separately from the regulation blade to accommodate the developer, the development frame having a mount portion for mounting the regulation blade; and a sheet member, wherein the regulation blade has a sticking portion for adhering the sheet member, and when the regulation blade is mounted to the mount portion of the development frame, and the sheet member is adhered to the sticking portion of the regulation blade, the sheet member is adhered on the sticking portion so the sheet member enters into the developing area where the electrostatic latent image formed on the image bearing member is developed at a downstream side of a position where the developer bearing member is closest to the regulation blade and at an upstream side of a position where the developer bearing member is closest to the image bearing member with respect to a rotational direction of the developer bearing member.

14. The developing device according to claim 13, wherein the mount portion of the development frame is provided in a region corresponding to a maximum image region of the image bearing member, and the regulation blade is mounted, using an adhesive, to the region corresponding to the maximum image region of the image bearing member in the mount portion of the development frame.

15. The developing device according to claim 14, wherein the regulation blade is mounted, using the adhesive, over the entirety of the region corresponding to the maximum image region of the image bearing member in the mount portion of the development frame.

16. The developing device according to claim 13, wherein the regulation blade has a rigidity capable of being flexed.

* * * * *